US011319674B2

(12) United States Patent
Aoyama et al.

(10) Patent No.: US 11,319,674 B2
(45) Date of Patent: May 3, 2022

(54) FIBROUS BODY MANUFACTURING APPARATUS AND FIBROUS BODY MANUFACTURING METHOD

(71) Applicant: SEIKO EPSON CORPORATION, Tokyo (JP)

(72) Inventors: Tetsuya Aoyama, Nagano (JP); Yoichi Miyasaka, Nagano (JP); Kaneo Yoda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 17/066,536

(22) Filed: Oct. 9, 2020

(65) Prior Publication Data

US 2021/0108372 A1 Apr. 15, 2021

(30) Foreign Application Priority Data

Oct. 11, 2019 (JP) ..... JP2019-187478

(51) Int. Cl.

| | |
|---|---|
| ***D21H 23/50*** | (2006.01) |
| ***D21H 23/78*** | (2006.01) |
| ***D21H 21/14*** | (2006.01) |
| ***D21H 17/20*** | (2006.01) |

(52) U.S. Cl.

CPC ..... *D21H 23/50* (2013.01); *D21H 17/20* (2013.01); *D21H 21/14* (2013.01); *D21H 23/78* (2013.01)

(58) Field of Classification Search

USPC ..... 162/164.1

See application file for complete search history.

(56) References Cited

U.S. PATENT DOCUMENTS 8,882,965 B2 11/2014 Yamagami et al.

FOREIGN PATENT DOCUMENTS

| | | | |
|---|---|---|---|
| JP | 2006-002296 | A | 1/2006 |
| JP | 2011-212255 | A | 10/2011 |
| JP | 2012-034867 | A | 2/2012 |
| JP | 2012-144826 | A | 8/2012 |

*Primary Examiner* — Mark Halpern

(74) *Attorney, Agent, or Firm* — Global IP Counselors, LLP

(57) ABSTRACT

A fibrous body manufacturing apparatus for manufacturing a fibrous body includes an accumulating section that accumulates a sheet-shaped fibrous material containing a plurality of fibers, a droplet discharging section that discharges, as droplets, a binding material that binds the fibers of the accumulated fibrous material to each other, and a control section which segments a region in which the liquid is dischargeable onto the fibrous material into a plurality of segments, generates discharge data in which discharge information on the liquid is set for every one of the plurality of segments, and causes the liquid to be discharged from the droplet discharging section toward the fibrous material based on the discharge data.

8 Claims, 13 Drawing Sheets

FIBROUS BODY MANUFACTURING APPARATUS AND FIBROUS BODY MANUFACTURING METHOD

The present application is based on, and claims priority from JP Application Serial Number 2019-187478, filed Oct. 11, 2019, the disclosure of which is hereby incorporated by reference here in its entirety.

BACKGROUND

1. Technical Field

The present disclosure relates to a fibrous body manufacturing apparatus and a fibrous body manufacturing method.

2. Related Art

In the related art, as indicated in JP-A-2012-144826, there is known a paper recycling apparatus that sprays a binding material that binds fibers of a fibrous material using a sprayer toward the fibrous material containing a plurality of fibers.

Incidentally, in recycled paper formed by a paper recycling apparatus, a strength difference may arise caused by, for example, variations in the manufacturing process. In such a case, it is necessary to improve the binding strength between the fibers at locations at which the fibers are weakly bound to each other and secure a stable strength of the entirety of the recycled paper by applying more binding material to the locations in the fibrous material. There may be a case in which the binding strength between the fibers is to be intentionally controlled within the surface of the recycled paper formed by the paper recycling apparatus. However, there is a problem in that it is difficult to appropriately set the application amount of the binding material depending on the location of the fibrous material in the sprayer.

SUMMARY

According to an aspect of the present disclosure, there is provided a fibrous body manufacturing apparatus for manufacturing a fibrous body, the apparatus including an accumulating section that accumulates a sheet-shaped fibrous material containing a plurality of fibers, a droplet discharging section that discharges, as droplets, a liquid containing a binding material that binds the fibers of the accumulated fibrous material to each other, and a control section which segments a region in which the liquid is dischargeable onto the fibrous material into a plurality of segments, generates discharge data in which discharge information on the liquid is set for every one of the plurality of segments, and causes the liquid to be discharged from the droplet discharging section toward the fibrous material based on the discharge data.

In the fibrous body manufacturing apparatus, the control section may set the discharge amount of the liquid for every one of the segments as the discharge information.

In the fibrous body manufacturing apparatus, the control section may generate the discharge data such that, of the plurality of segments, the discharge amount of the liquid in the segments on an outside is larger than the discharge amount of the liquid in the segments on an inside.

In the fibrous body manufacturing apparatus, the control section may generate the discharge data such that the discharge amount of the liquid in the segments corresponding to diagonal lines on the sheet-shaped fibrous material is larger than the discharge amount of the liquid in the segments other than the segments along the diagonal lines.

In the fibrous body manufacturing apparatus, when the control section segments the region into the plurality of segments, sizes of the segments may be made different.

In the fibrous body manufacturing apparatus, the control section may set first segmented region data configured from first segments in which a region in which the liquid is dischargeable onto the fibrous material is treated as a plurality of segments, and, separately from the first segmented region data, may set second segmented region data configured from second segments in which a region in which the liquid is dischargeable onto the fibrous material is treated as a plurality of segments, may generate first discharge data in which the discharge information is set for every one of the first segments of the first segmented region data and cause the liquid to be discharged from the droplet discharging section toward the fibrous material based on the first discharge data, and may generate second discharge data in which the discharge information is set for every one of the second segments of the second segmented region data and cause the liquid to be discharged from the droplet discharging section toward the fibrous material based on the second discharge data.

In the fibrous body manufacturing apparatus, the droplet discharging section may be provided with a first nozzle and a second nozzle for discharging the liquid as droplets, and the control section may generate the discharge data for discharging the liquid from the first nozzles and the second nozzles in the same raster in the plurality of segments.

The fibrous body manufacturing apparatus may further include a detection section for acquiring information on the fibrous material accumulated on the accumulating section, and the control section may generate the discharge data based on detection data acquired by the detection section.

According to another aspect of the present embodiment, there is provided a fibrous body manufacturing method for manufacturing a fibrous body, the method including accumulating a sheet-shaped fibrous material containing a plurality of fibers, and segmenting a region in which a liquid containing a binding material that binds the fibers to each other is dischargeable onto the fibrous material into a plurality of segments, generating discharge data in which discharge information on the liquid is set for every one of the plurality of segments, and causing the liquid to be discharged toward the fibrous material based on the discharge data.

DESCRIPTION OF EXEMPLARY EMBODIMENTS

1. First Embodiment

Figure 1:
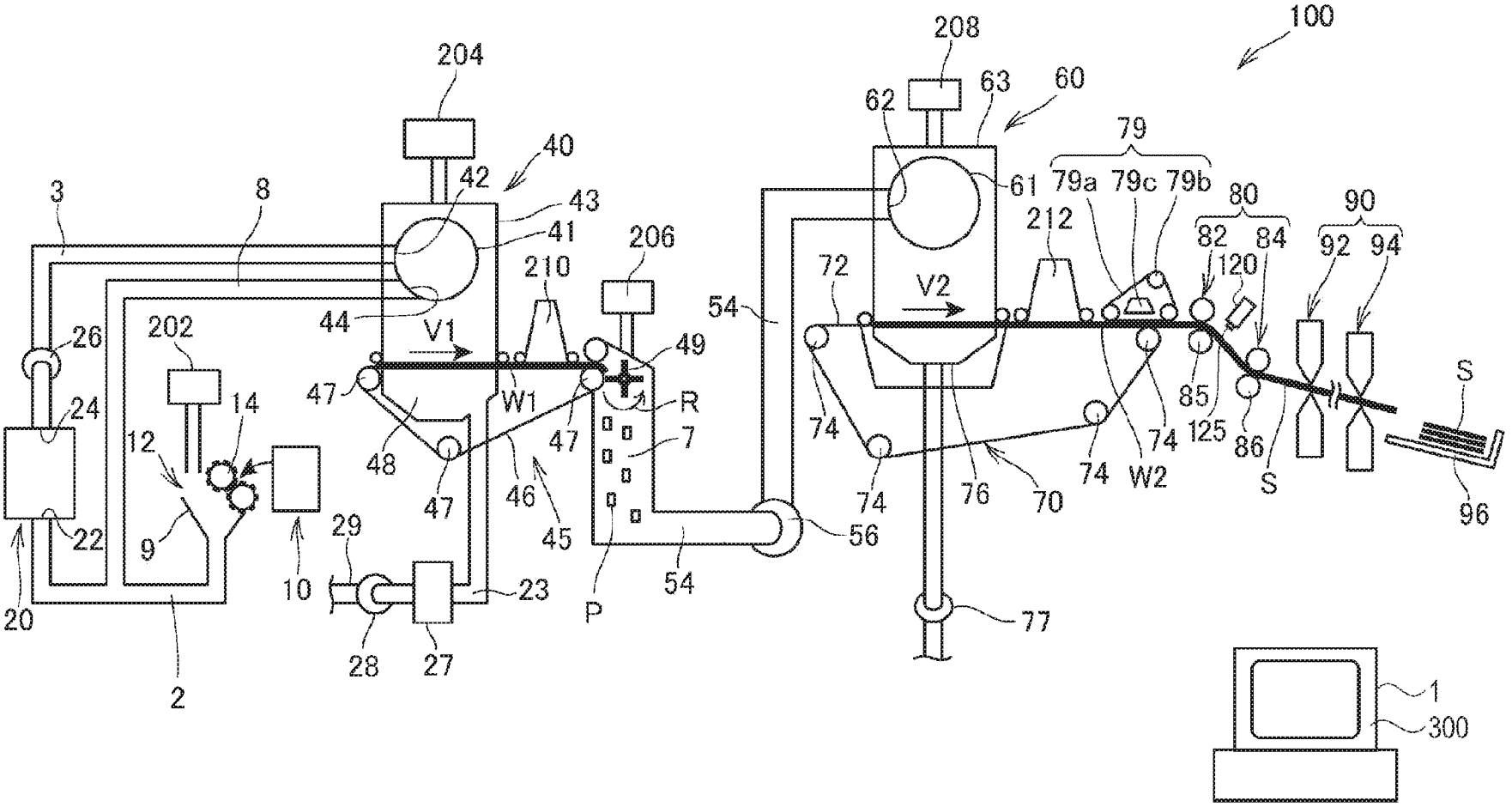
FIG. 1 is a schematic diagram illustrating a configuration of a fibrous body manufacturing apparatus according to a first embodiment.

First, a fibrous body manufacturing apparatus 100 according to the present embodiment will be described. FIG. 1 is a schematic diagram illustrating the configuration of the fibrous body manufacturing apparatus 100 according to the present embodiment.

The fibrous body manufacturing apparatus 100 is, for example, a suitable apparatus for manufacturing a sheet S as a new fibrous body by defibrating used old paper as a raw material using a dry method to form fibers and subsequently subjecting the result to pressurizing, heating, and cutting. In the fibrous body manufacturing apparatus 100, by controlling the density, thickness and shape of the sheet S to mold the sheet S, it is possible to manufacture the sheet S having various thicknesses and sizes according to the application, such as A4 or A3 office paper and business card paper.

The fibrous body manufacturing apparatus 100 includes, for example, a supply section 10, a crushing section 12, a defibrating section 20, a sorting section 40, a first web forming section 45, a rotating body 49, an accumulating section 60, a second web forming section 70, a transport section 79, a sheet forming section 80, a cutting section 90, and a droplet discharging section 120.

The fibrous body manufacturing apparatus 100 includes, for example, humidifying sections 202, 204, 206, 208, 210, and 212 for the purpose of humidifying the raw material and humidifying the space in which the raw material moves.

The humidifying sections 202, 204, 206, and 208 are configured by, for example, evaporating or warm air vaporizers. In other words, the humidifying sections 202, 204, 206, and 208 supply humidified air having increased humidity by including filters (not illustrated) infiltrated with water and causing air to pass through the filters. The humidifying sections 202, 204, 206, and 208 may be provide with heaters (not illustrated) that effectively increase the humidity of the humidified air. The humidifying sections 210 and 212 are configured by ultrasonic humidifiers, for example. In other words, the humidifying sections 210 and 212 include oscillating sections (not illustrated) that atomize water and supply mist generated by the oscillating sections.

The fibrous body manufacturing apparatus 100 is provided with a computer 1 including a control section 300 that controls driving of the entirety of the fibrous body manufacturing apparatus 100. The computer 1 is a general-purpose personal computer that may be used by a user. The control section 300 is provided with a CPU that executes various control instructions, a RAM that temporarily stores data, a ROM that stores various control programs, a hard disk device that is a large-capacity memory that stores various application programs and various data files, and the like. The control section 300 is provided with an input device into which it is possible to input instructions from the user, such as a keyboard and a mouse, and an interface which may be coupled to a display or the like.

The supply section 10 supplies the raw material to the crushing section 12. The raw material supplied to the crushing section 12 may be any material containing fibers, and examples thereof include paper, pulp, pulp sheet, non-woven fabric, cloth, and woven fabric. Hereinafter, a configuration in which the fibrous body manufacturing apparatus 100 uses waste paper as a raw material is exemplified. The supply section 10 includes, for example, a stacker that stacks and accumulates waste paper, and an automatic feeding device that sends the waste paper from the stacker to the crushing section 12. It is not always necessary to align and stack the waste paper, and waste paper of various sizes or waste paper of various shapes may be supplied to the stacker in a non-uniform manner.

The crushing section 12 cuts the raw material supplied by the supply section 10 using a crushing blade 14 to form crushed pieces. The crushing blade 14 cuts the raw material in a gas such as the atmosphere. The crushing section 12 includes, for example, a pair of crushing blades 14 that pinch and cut the raw material and a drive section that causes the crushing blade 14 to rotate, and it is possible to adopt the same configuration as a so-called shredder. The shape and size of the crushed pieces are arbitrary and it is sufficient that the size and shape be suitable for the defibration process in the defibrating section 20. The crushing section 12 cuts the raw material into pieces of paper having a size of less than or equal to 1 cm to several cm square, for example.

The crushing section 12 includes a chute 9 that receives the crushed pieces that are cut by the crushing blade 14 and fall. The chute 9 has, for example, a tapered shape in which the width gradually narrows in the direction in which the crushed pieces flow. Therefore, the chute 9 is capable of receiving many crushed pieces. A pipe 2 communicating with the defibrating section 20 is connected to the chute 9 and the pipe 2 forms a transport path for transporting the crushed pieces to the defibrating section 20. The crushed pieces are collected by the chute 9 and transported to the defibrating section 20 through the pipe 2. The crushed pieces are transported in the pipe 2 toward the defibrating section 20 by an air flow generated by a blower (not illustrated), for example.

Humidified air is supplied by the humidifying section 202 to the chute 9 included in the crushing section 12 or to the vicinity of the chute 9. Accordingly, it is possible to suppress a phenomenon in which the crushed matter cut by the crushing blade 14 is adsorbed to the chute 9 or the inner surface of the pipe 2 due to static electricity. Since the crushed matter cut by the crushing blade 14 is transported to the defibrating section 20 together with humidified high-humidity air, an effect of suppressing adhesion of the defibrated matter in the inner portion of the defibrating section 20 may be expected. The humidifying section 202 may be configured to supply the humidified air to the crushing blade 14 to remove the charge of the raw material supplied by the supply section 10. The humidifying section 202 may be used together with an ionizer to remove the charge.

The defibrating section 20 defibrates the crushed matter cut by the crushing section 12. More specifically, the defibrating section 20 subjects the raw material cut by the crushing section 12 to a defibration process and generates the defibrated matter. Here, "to defibrate" refers to unraveling the raw material, formed by binding a plurality of fibers, into individual fibers. The defibrating section 20 has a function of separating substances such as resin particles, ink, toner, and anti-bleeding agents adhered to the raw material from the fibers.

The matter is referred to as defibrated matter after passing through the defibrating section 20. The defibrated matter may include, in addition to the defibrated fibers that are unraveled, resin particles separated from the fibers when the fibers are unraveled, that is, resin particles for binding a plurality of fibers to each other, color materials such as ink or toner, and additives such as anti-bleeding agents and paper strength enhancers. The shape of the unraveled defibrated matter is a string or a flat string. The unraveled defibrated matter may be present in a state of not being entangled with other unraveled fibers, that is, in an independent state, or may be present in a state of being entangled with other untangled defibrated matter to form lumps, that is, a state of forming clumps.

The defibrating section 20 performs defibration using a dry method. Here, the process of performing defibration or the like in air such as in the atmosphere, rather than in a liquid, is referred to as a dry method. The defibrating section 20 is configured using the impeller mill, for example. Specifically, although not illustrated the defibrating section 20 includes a rotor that rotates at a high speed and a liner positioned on the outer periphery of the rotor. The crushed pieces cut by the crushing section 12 are pinched between the rotor and the liner of the defibrating section 20 to be defibrated. The defibrating section 20 generates an airflow by the rotation of the rotor. Due to the air flow, the defibrating section 20 is capable of sucking the crushed pieces, which are the raw material, from the pipe 2 and transporting the defibrated matter to a discharge port 24. The defibrated matter is sent from the discharge port 24 to a pipe 3 and is transported to the sorting section 40 via the pipe 3.

As described above, the defibrated matter generated by the defibrating section 20 is transported from the defibrating section 20 to the sorting section 40 by the airflow generated by the defibrating section 20. Furthermore, in the illustrated example, the fibrous body manufacturing apparatus 100 is provided with a defibrating blower 26 which is an airflow generation device and the defibrated matter is transported to the sorting section 40 by the airflow generated by the defibrating blower 26. The defibrating blower 26 is attached to the pipe 3, sucks air together with the defibrated matter from the defibrating section 20, and blows the air to the sorting section 40.

The sorting section 40 is provided with an inlet 42 through which the defibrated matter defibrated by the defibrating section 20 from the pipe 3 flows in together with the airflow. The sorting section 40 sorts the defibrated matter introduced into the inlet 42 according to the length of the fibers. Specifically, of the defibrated matter defibrated by the defibrating section 20, the sorting section 40 sorts the defibrated matter of less than or equal to a predetermined size as a first sorted matter and the defibrated matter larger than the first sorted matter as the second sorted matter. The first sorted matter contains fibers or particles and the second sorted matter contains, for example, large fibers, non-defibrated pieces, crushed pieces that are not sufficiently defibrated, clumps in which defibrated fibers are agglomerated or entangled.

The sorting section 40 includes a drum portion 41 and a housing portion 43 that houses the drum portion 41.

The drum portion 41 is a cylindrical sieve that is rotationally driven by a motor. The drum portion 41 includes a screen and functions as a sieve. The drum portion 41 uses the mesh of the screen to perform sorting into a first sorted matter smaller than the size of the mesh openings of the screen and a second sorted matter larger than the size of the mesh openings of the screen. It is possible to use, for example, a wire mesh, an expanded metal obtained by extending a notched metal plate, or a punching metal in which holes are formed in a metal plate by a press machine or the like as the screen of the drum portion 41.

The defibrated matter introduced into the inlet 42 is sent into the inner portion of the drum portion 41 together with the airflow and the first sorted matter falls downward from the mesh of the screen of the drum portion 41 due to the rotation of the drum portion 41. The second sorted matter that may not pass through the mesh of the screen of the drum portion 41 is caused to flow by the airflow flowing from the inlet 42 into the drum portion 41, guided to a discharge port 44, and sent out to a pipe 8.

The pipe 8 connects the inner portion of the drum portion 41 and the pipe 2 to each other. The second sorted matter flowing through the pipe 8 flows through the pipe 2 together with the crushed pieces cut by the crushing section 12 and is guided to an inlet 22 of the defibrating section 20. Accordingly, the second sorted matter is returned to the defibrating section 20 and is subjected to a defibration process.

The first sorted matter sorted by the drum portion 41 passes through the mesh of the screen of the drum portion 41, is dispersed in the air, and falls toward a mesh belt 46 of the first web forming section 45 positioned below the drum portion 41.

The first web forming section 45 includes the mesh belt 46, rollers 47, and a suction section 48. The mesh belt 46 is an endless belt, is suspended by the three rollers 47, and is transported in a direction indicated by the arrow in the drawing by the movement of the rollers 47. The surface of the mesh belt 46 is configured by a screen having openings of a predetermined size. Of the first sorted matter descending from the sorting section 40, the fine particles of a size that passes through the mesh of the screen drop below the mesh belt 46, and the fibers of a size that may not pass through the mesh of the screen are accumulated on the mesh belt 46 and are transported in the arrow direction together with the mesh belt 46. The fine particles that drop from the mesh belt 46 include relatively small or low density particles in the defibrated matter, that is, include resin particles, color materials, additives, and the like which are not necessary for binding the fibers to each other. The fine particles are removed matter not used by the fibrous body manufacturing apparatus 100 in the manufacturing of the sheet S.

The mesh belt 46 moves at a constant speed V1 during the normal operation of manufacturing the sheet S. Here, "during normal operation" indicates during operation other than during execution of startup control and stopping control of the fibrous body manufacturing apparatus 100, and more specifically, indicates the duration in which the fibrous body manufacturing apparatus 100 manufactures the sheet S of a desired quality.

Therefore, the defibrated matter subjected to the defibration process by the defibrating section 20 is sorted by the sorting section 40 into the first sorted matter and the second sorted matter, and the second sorted matter is returned to the defibrating section 20. The removed matter is removed from the first sorted matter by the first web forming section 45. The rest of the first sorted matter after removing the removed matter is a material suitable for manufacturing the sheet S, and the material is accumulated on the mesh belt 46 to form a first web W1.

The suction section 48 sucks air from below the mesh belt 46. The suction section 48 is connected to a dust collecting section 27 via a pipe 23. The dust collecting section 27 is a filter-type or cyclone-type dust collector and separates fine particles from the air flow. A collection blower 28 is installed downstream of the dust collecting section 27 and the collection blower 28 functions as a dust collection suction section that sucks air from the dust collecting section 27. The air discharged by the collection blower 28 is discharged to the outside of the fibrous body manufacturing apparatus 100 via a pipe 29.

In the fibrous body manufacturing apparatus 100, the collection blower 28 sucks air from the suction section 48 through the dust collecting section 27. In the suction section 48, the fine particles that pass through the mesh of the screen of the mesh belt 46 are sucked together with the air and sent to the dust collecting section 27 through the pipe 23. The dust collecting section 27 separates and accumulates the fine particles that pass through the mesh belt 46 from the air flow.

Therefore, the fibers obtained by removing the removed matter from the first sorted matter accumulate on the mesh belt 46 to form the first web W1. Due to the collection blower 28 performing the sucking, the formation of the first web W1 on the mesh belt 46 is promoted and the removed matter is swiftly removed.

The humidified air is supplied to the space including the drum portion 41 by the humidifying section 204. The humidified air humidifies the first sorted matter in the inner portion of the sorting section 40. Accordingly, it is possible to weaken the adhesion of the first sorted matter to the mesh belt 46 due to an electrostatic force and render the first sorted matter more easy to separate from the mesh belt 46. Furthermore, it is possible to suppress the adhesion of the first sorted matter to the rotating body 49 or the inner wall of the housing portion 43 due to the electrostatic force. The suction section 48 is capable of efficiently sucking the removed matter.

In the fibrous body manufacturing apparatus 100, the configuration for sorting and separating the first sorted matter and the second sorted matter from each other is not limited to the sorting section 40 provided with the drum portion 41. For example, a configuration may be adopted in which the defibrated matter subjected to the defibration process by the defibrating section 20 is classified by a classifier. It is possible to use a cyclone classifier, an elbow jet classifier, or an eddy classifier as the classifier, for example. By using these classifiers, it is possible to sort and separate the first sorted matter and the second sorted matter from each other. Furthermore, using the above classifiers, it is possible to realize a configuration in which relatively small or low density matter in the defibrated matter, that is, the removed matter containing resin particles, color materials, additives, and the like not necessary for binding fibers to each other is separated and removed. For example, a configuration may be adopted in which the fine particles contained in the first sorted matter are removed from the first sorted matter by a classifier. In this case, a configuration may be adopted in which, for example, the second sorted matter is returned to the defibrating section 20, the removed matter is collected by the dust collecting section 27, and the first sorted matter excluding the removed matter is sent to a pipe 54.

In the transport path of the mesh belt 46, the humidifying section 210 supplies air containing mist downstream of the sorting section 40. The mist, which is fine particles of water generated by the humidifying section 210, descends toward the first web W1 and supplies water to the first web W1. Accordingly, the amount of water contained in the first web W1 is adjusted, and it is possible to suppress the adsorption of fibers to the mesh belt 46 due to static electricity.

The fibrous body manufacturing apparatus 100 includes the rotating body 49 that divides the first web W1 accumulated on the mesh belt 46. The first web W1 is separated from the mesh belt 46 at the position at which the mesh belt 46 is folded back by the roller 47 and is divided by the rotating body 49.

The first web W1 is a soft material in which fibers are accumulated to form a web shape, and the rotating body 49 loosens the fibers of the first web W1.

The configuration of the rotating body 49 is arbitrary, but in the illustrated example, the rotating body 49 has a rotary blade shape including plate-shaped blades and rotating. The rotating body 49 is disposed at a position at which the first web W1 to be peeled from the mesh belt 46 and the blade come into contact with each other. Due to the rotation of the rotating body 49, for example, the rotation in the direction indicated by an arrow R in the drawing, the blades collide with the first web W1 separated from the mesh belt 46 and transported to be divided, and a subdivided body P is generated.

The rotating body 49 is preferably installed at a position at which the blades of the rotating body 49 do not collide with the mesh belt 46. For example, it is possible to render the interval between the tips of the blades of the rotating body 49 and the mesh belt 46 to 0.05 mm to 0.5 mm, and in this case, it is possible to use the rotating body 49 to efficiently divide the first web W1 without damaging the mesh belt 46.

The subdivided body P divided by the rotating body 49 descends in the inner portion of a pipe 7 and is transported to the pipe 54 by the airflow flowing in the inner portion of the pipe 7.

The humidified air is supplied to the space including the rotating body 49 by the humidifying section 206. Accordingly, it is possible to suppress a phenomenon in which the fibers are adsorbed to the inner portion of the pipe 7 and the blades of the rotating body 49 due to static electricity.

Due to the air flow generated by a blower 56, the subdivided body P that descends in the pipe 7 is sucked into the inner portion of the pipe 54 and passes through the inner portion of the blower 56. The subdivided body P is transported to the accumulating section 60 through the pipe 54 by the action of the air flow generated by the blower 56 and the action of a rotating portion such as the blade of the blower 56.

The accumulating section 60 introduces the subdivided body P from an inlet 62, loosens the entangled defibrated matter, and causes the defibrated matter to descend while dispersing the defibrated matter in the air. The accumulating section 60 causes a second web W2, which is a sheet-shaped fibrous material containing a plurality of fibers, to accumulate on the second web forming section 70 with good uniformity.

The accumulating section 60 includes a drum portion 61 and a housing portion 63 that houses the drum portion 61. The drum portion 61 is a cylindrical sieve that is rotationally driven by a motor. The drum portion 61 includes a screen and functions as a sieve. Due to the mesh of the screen, the drum portion 61 allows fibers and particles smaller than the mesh openings of the screen to pass through and descend from the drum portion 61. The configuration of the drum portion 61 is the same as the configuration of the drum portion 41, for example.

The "sieve" of the drum portion 61 may not necessarily have a function of sorting a specific target object. In other words, the "sieve" used as the drum portion 61 means that something provided with a screen, and the drum portion 61 may cause all the defibrated matter introduced into the drum portion 61 to descend.

The second web forming section 70 is disposed below the drum portion 61. The second web forming section 70 accumulates the passing material that passed through the accumulating section 60 to form the second web W2. The second web forming section 70 includes a mesh belt 72, rollers 74, and a suction mechanism 76, for example.

The mesh belt 72 is an endless belt, is suspended by the plurality of rollers 74, and is transported in the direction indicated by the arrow in the drawing by the movement of the rollers 74. The mesh belt 72 is made of metal, resin, cloth, or is a non-woven fabric. The surface of the mesh belt 72 is configured of a screen having openings of a predetermined size. Of the fibers descending from the drum portion 61, the fibers of a size that passes through the mesh of the screen drop below the mesh belt 72, and the fibers of a size that may not pass through the mesh of the screen are accumulated on the mesh belt 72 and are transported in the arrow direction together with the mesh belt 72. The mesh belt 72 moves at a constant speed V2 during the normal operation of manufacturing the sheet S. The expression "during normal operation" is as described above.

The mesh of the screen of the mesh belt 72 is fine and may be of a size at which the majority of the fibers falling from the drum portion 61 do not pass through.

The suction mechanism 76 is provided below the mesh belt 72. The suction mechanism 76 is provided with a suction blower 77, and it is possible to generate an airflow directed downward in the suction mechanism 76 using the suction force of the suction blower 77.

The suction mechanism 76 is used to suck the defibrated matter dispersed in the air by the accumulating section 60 onto the mesh belt 72. Accordingly, the formation of the second web W2 on the mesh belt 72 is promoted and it is possible to increase the discharge speed from the accumulating section 60. Furthermore, it is possible to use the suction mechanism 76 to form a downflow in the falling path of the defibrated matter, and it is possible to prevent the defibrated matter from being entangled during the fall.

The suction blower 77 may discharge the air sucked from the suction mechanism 76 to the outside of the fibrous body manufacturing apparatus 100 through a collection filter (not illustrated). Alternatively, the air sucked by the suction blower 77 may be sent into the dust collecting section 27 and the removed matter contained in the air sucked by the suction mechanism 76 may be collected.

The humidified air is supplied to the space including the drum portion 61 by the humidifying section 208. The humidified air is capable of humidifying the inner portion of the accumulating section 60, the adhesion of the fibers to the housing portion 63 due to electrostatic force is suppressed, and the fibers are swiftly caused to descend to the mesh belt 72, and it is possible to form the second web W2 having a preferable shape.

As described above, the second web W2 that contains a large amount of air and is soft and bulged is formed by passing through the accumulating section 60 and the second web forming section 70. The second web W2 accumulated on the mesh belt 72 is transported to the sheet forming section 80.

In the transport path of the mesh belt 72, the humidifying section 212 supplies air containing mist downstream of the accumulating section 60. Accordingly, the mist generated by the humidifying section 212 is supplied to the second web W2 and the amount of water contained in the second web W2 is adjusted. Accordingly, it is possible to suppress adsorption of fibers to the mesh belt 72 due to static electricity.

The fibrous body manufacturing apparatus 100 includes a transport section 79 that transports the second web W2 on the mesh belt 72 to the sheet forming section 80. The transport section 79 includes a mesh belt 79*a*, rollers 79*b*, and a suction mechanism 79*c*, for example.

The suction mechanism 79*c* is provided with a blower (not illustrated) and generates an upward airflow in the mesh belt 79*a* using the suction force of the blower. The air flow sucks the second web W2, and the second web W2 is separated from the mesh belt 72 and adsorbed to the mesh belt 79*a*. The mesh belt 79*a* moves by the rotation of the rollers 79*b* and transports the second web W2 to the sheet forming section 80. The movement speed of the mesh belt 72 and the movement speed of the mesh belt 79*a* are, for example, the same.

In this manner, the transport section 79 peels the second web W2 formed on the mesh belt 72 from the mesh belt 72 and transports the second web W2.

The sheet forming section 80 forms the sheet S from the accumulated matter accumulated by the accumulating section 60. More specifically, the sheet forming section 80 pressurizes and heats the second web W2 accumulated on the mesh belt 72 and transported by the transport section 79 to mold the sheet S.

The sheet forming section 80 includes a pressurizing section 82 that pressurizes the second web W2 and a heating section 84 that heats the second web W2 pressurized by the pressurizing section 82.

The pressurizing section 82 is configured by a pair of calender rollers 85 and pinches the second web W2 to pressurize the second web W2 with a predetermined nip pressure. The thickness of the second web W2 is reduced by being pressurized and the density of the second web W2 is increased. One of the pair of calender rollers 85 is a drive roller driven by a motor (not illustrated) and the other is a driven roller. The calender rollers 85 are rotated by the driving force of the motor and transport the second web W2, which has a high density due to the pressure, toward the heating section 84.

The heating section 84 is configured by a heating roller, a heat press molding machine, a hot plate, a warm air blower, an infrared heater, a flash fixing device, or the like, for example. In the illustrated example, the heating section 84 is provided with a pair of heating rollers 86. The heating rollers 86 are heated to a preset temperature by a heater installed inside or outside. The heating rollers 86 pinch the second web W2 pressurized by the calender rollers 85 to apply heat and form the sheet S.

One of the pair of heating rollers 86 is a drive roller driven by a motor (not illustrated) and the other is a driven roller. The heating rollers 86 are rotated by the driving force of the motor to transport the heated sheet S toward the cutting section 90.

In this manner, the second web W2 formed in the accumulating section 60 is pressurized and heated in the sheet forming section 80 to form the sheet S.

The number of calender rollers 85 provided in the pressurizing section 82 and the number of heating rollers 86 provided in the heating section 84 are not particularly limited.

Here, the droplet discharging section 120 is disposed between the pressurizing section 82 and the heating section 84 in the transport direction. The droplet discharging section 120 discharges a liquid containing a binder as a binding material that binds the fibers of the second web W2 to each other as droplets. A liquid containing the binder is caused to adhere to the second web W2 and a heating process is subsequently performed by the heating section 84, whereby the fibers are bound to each other by the binder. The detailed configuration of the droplet discharging section 120 will be described later.

The cutting section 90 cuts the sheet S molded by the sheet forming section 80. In the illustrated example, the cutting section 90 includes a first cutting section 92 that cuts the sheet S in a direction intersecting the transport direction of the sheet S and a second cutting section 94 that cuts the sheet S in a direction parallel to the transport direction. The second cutting section 94 cuts the sheet S that passes through the first cutting section 92, for example.

As described above, the single-cut sheet S of a predetermined size is molded. The cut single-cut sheet S is discharged to a discharge section 96. The discharge section 96 includes a tray or a stacker on which sheets S of a predetermined size are placed.

Although not illustrated, the humidifying sections 202, 204, 206, and 208 may be configured by a single vaporizing humidifier. In this case, the humidified air generated by the single humidifier branches to be supplied to the crushing section 12, the housing portion 43, the pipe 7, and the housing portion 63. It is possible to easily realize this configuration by branching and installing a duct supplying the humidified air. It is also possible to configure the humidifying sections 202, 204, 206, and 208 using two or three vaporizing humidifiers.

The humidifying sections 210 and 212 may be configured by a single ultrasonic humidifier or may be configured by two ultrasonic humidifiers. For example, air containing mist generated by the single humidifier is branched and supplied to the humidifying sections 210 and 212.

Next, the configuration of the droplet discharging section 120 will be described.

The droplet discharging section 120 discharges a liquid containing a binder for binding the fibers to each other as a droplet onto the sheet-shaped second web W2 containing a plurality of fibers, and applies the liquid to the second web W2.

The droplet discharging section 120 is provided with a discharge head 125 including a plurality of nozzles. The discharge head 125 is disposed to face one surface of the second web W2 being transported. The discharge head 125 discharges the liquid as minute droplets from the nozzle using an ink jet system. The droplet discharging section 120 is provided with a discharge mechanism of a serial system that discharges the liquid as droplets while causing the discharge head 125 to reciprocate in directions intersecting the transport direction of the second web W2.

The droplet discharging section 120 discharges the liquid containing the binder as droplets onto the second web W2 pressurized by the pressurizing section 82. Due to being pressurized by the pressurizing section 82, the bulk density of the second web W2 becomes greater than or equal to 0.09 g/cm$^3$. In other words, the pressurizing section 82 pressurizes the second web W2 such that the bulk density of the second web W2 becomes greater than or equal to 0.09 g/cm$^3$ and the droplet discharging section 120 applies the liquid to the second web W2 with the bulk density of 0.09 g/cm$^3$. The droplet discharging section 120 applies the liquid to the second web W2 having a bulk density of preferably 0.09 g/cm$^3$ to 0.80 g/cm$^3$ and more preferably 0.20 g/cm$^3$ to 0.70 g/cm$^3$. The expression "bulk density" means loose bulk density.

The pressure applied to the second web W2 by the pressurizing section 82 is, for example, 1 kgf/cm$^2$ to 600 kgf/cm$^2$, preferably 1 kgf/cm$^2$ to 500 kgf/cm$^2$, and more preferably 3 kgf/cm$^2$ to 300 kgf/cm$^2$.

The heating section 84 heats the second web W2 to which the liquid is applied by the droplet discharging section 120. The second web W2 is heated by the heating section 84 to form the sheet S. The temperature of the heating section 84 is, for example, 70° C. to 220° C. and preferably 100° C. to 180° C.

The liquid discharged from the droplet discharging section 120 contains a binder that binds the plurality of fibers of the second web W2. No binder is contained in the second web W2 before the liquid is applied. The binder contained in the liquid is, for example, a thermoplastic resin or a thermosetting resin. Examples of the thermoplastic resin include styrene butadiene copolymer, acrylonitrile butadiene copolymer, acrylic ester copolymer, styrene acrylate copolymer, polyurethane, polyester, polyvinyl acetate, ethylene vinyl acetate copolymer, polyacrylamide, polyvinyl alcohol, and polyvinylpyrrolidone, for example. Examples of the thermosetting resin include epoxy resin, phenol resin, urea resin, melamine resin, unsaturated polyester resin, alkyd resin, diallyl phthalate resin, vinyl ester resin, and thermosetting polyimide, for example. The liquid may contain these resins alone or may contain a plurality of the resins. Considering that the liquid is easily discharged from the droplet discharging section 120, the liquid is preferably an emulsion.

The glass transition temperature of the thermoplastic resin and the thermosetting resin contained in the liquid is, for example, −50° C. to 130° C. and is preferably −30° C. to 100° C. As long as the glass transition temperature of the binder is within this range, it is possible to improve the binding of the fibers and to increase the paper strength.

The content of the binder in the liquid is, for example, 0.1% by mass to 30.0% by mass and is preferably 0.1% by mass to 20.0% by mass. When the content is 0.1% by mass to 30.0% by mass, it is possible to reduce the viscosity of the liquid to the extent that it is possible to sufficiently discharge the liquid from the droplet discharging section 120.

The plurality of fibers contained in the second web W2 are bound by the binder contained in the liquid by being heated by the heating section 84. Although not illustrated, the second web W2 to which the liquid is adhered may be heated separately from the heating section 84 by hot air, infrared rays, electromagnetic waves, a heat roller, a heat press, or the like. Accordingly, it is possible to promote the melting, binding, and gelatinization of the binder contained in the liquid, and to promote the drying of water and the like.

The viscosity of the liquid at 20° C. is preferably 8.0 mPa·s. When the liquid viscosity exceeds 8.0 mPa·s, there is a case in which the viscosity is too large and it is difficult to discharge the liquid as droplets from the droplet discharging section 120.

The liquid may include a penetrant. Accordingly, it is possible to improve the capability of the liquid to penetrate the second web W2 in the thickness direction. Therefore, it is possible to improve the fiber binding in the inner portion of the sheet S and to reduce the delamination of the sheet S and increase the tensile strength of the sheet S. Examples of the penetrant contained in the liquid include triethylene glycol monobutyl ether, reethylene glycol dimethyl ether, triethylene glycol diethyl ether, triethylene glycol dibutyl ether, triethylene glycol methyl butyl ether and other such glycol ethers, silicone-based surfactants, acetylene glycol-based surfactants, acetylene alcohol-based surfactants, and fluorine-based surfactants, for example. The liquid may contain these penetrants alone or may contain a plurality of the penetrants.

The content of the penetrant in the liquid is, for example, 0.1% by mass to 30.0% by mass and is preferably 0.1% by mass to 20.0% by mass. When the content is 0.1% by mass to 30.0% by mass, it is possible to promote the penetration of the liquid into the inner portion of the second web W2 and it is possible to increase the paper strength of the sheet S.

The liquid may include a humectant. Accordingly, when the liquid is discharged, it is possible to make it difficult for the nozzles of the droplet discharging section 120 to be clogged. Examples of the humectant contained in the liquid include diethylene glycol, triethylene glycol, propylene glycol, dipropylene glycol, 1,3-propanediol, 1,3-butylene glycol, 1,4-butanediol, 1,5-pentane diol, 1,6-hexanediol, 2-ethyl-2-methyl-1,3-propanediol, 2-methyl-2-propyl-1,3-propanediol, 2-methyl-1,3-propanediol, 2,2-dimethyl-1,3-propanediol, 3-methyl-1,3-butanediol, 1,2-hexanediol, 2-ethyl-1,3-hexanediol, 3-methyl-1,5-pentanediol, 2-methylpentane-2,4-diol, trimethylolpropane, glycerin, and the like. The liquid may contain these humectants alone or may contain a plurality of the humectants.

The content of the humectant in the liquid is, for example, 1.0% by mass to 30.0% by mass, preferably 3.0% by mass to 20.0% by mass, and more preferably 5.0% by mass to 16.0% by mass. As long as the content is 1.0% by mass to 30.0% by mass, it is possible to sufficiently suppress the clogging of the nozzle of the droplet discharging section 120.

The liquid may include water. Examples of water include deionized water, ultra-filtered water, reverse osmosis water, distilled water, and other pure water or ultrapure water. Water subjected to a sterilization process by irradiation with ultraviolet rays, addition of hydrogen peroxide, or the like is preferable in that this prevents the occurrence of mold and bacteria and enables long-term storage. For example, when the sheet S having the same bulk density is obtained, since the liquid contains water, the pressure of it is possible to reduce the pressure of the pressurizing section 82 as compared with a case in which the liquid does not contain water.

Examples of other additives that can be contained in the liquid include ultraviolet absorbers, photo-stabilizers, quenchers, antioxidants, water-proofing agents, antifungal agents, preservatives, thickeners, flow improvers, and pH regulators, defoamers, foam suppressors, leveling agents, antistatic agents, for example.

The control section 300 appropriately sets the application amount of the liquid containing the binder according to each location of the second web W2 being transported and controls the driving of the droplet discharging section 120 to manufacture the sheet S.

Hereinafter, a method of manufacturing the sheet S of a portion related to the droplet discharging section 120 will be described in particular.

Figure 2:
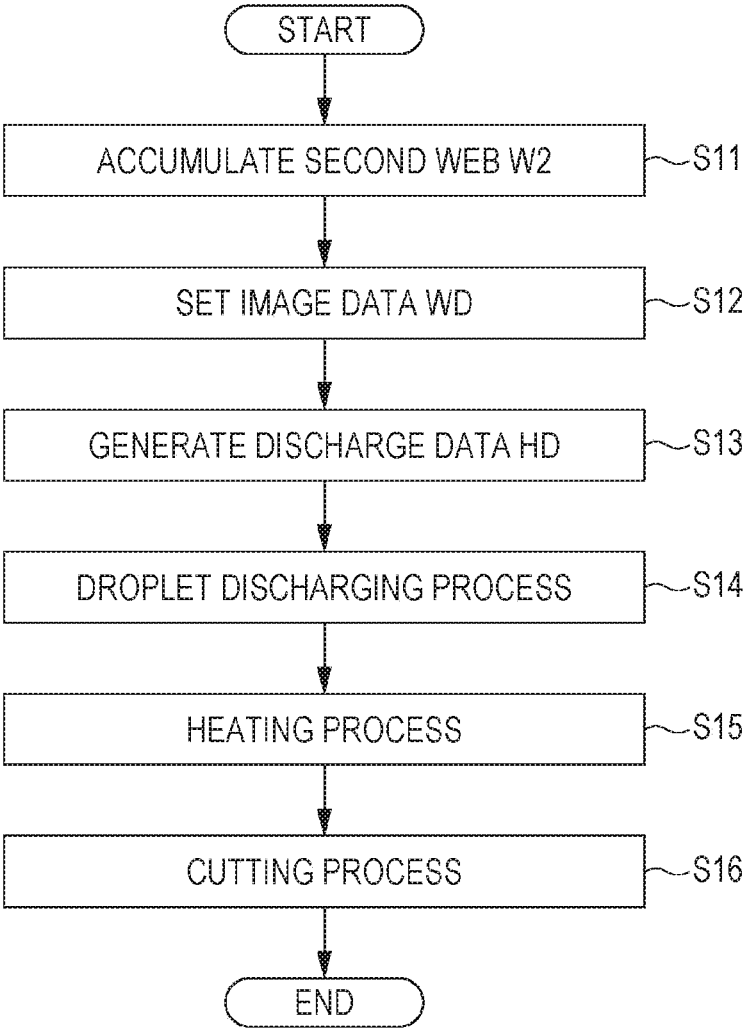
FIG. 2 is a flowchart illustrating a fibrous body manufacturing method according to the first embodiment.
Figure 3:
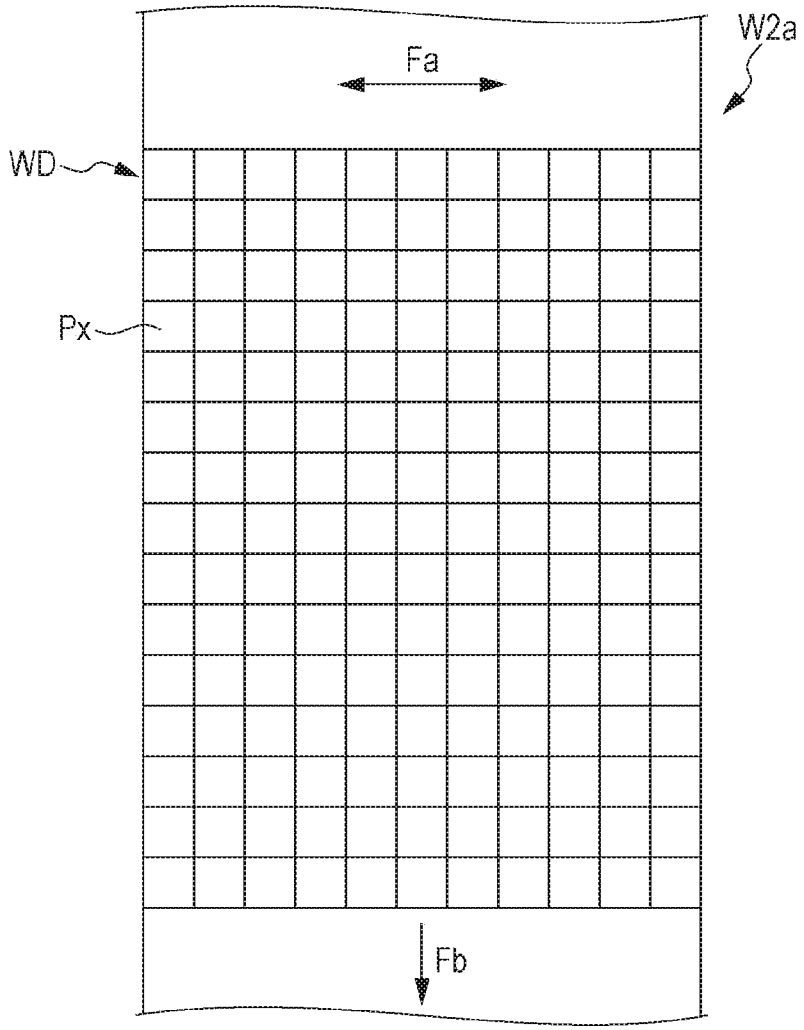
FIG. 3 is a schematic diagram describing the fibrous body manufacturing method according to the first embodiment.
Figure 4:
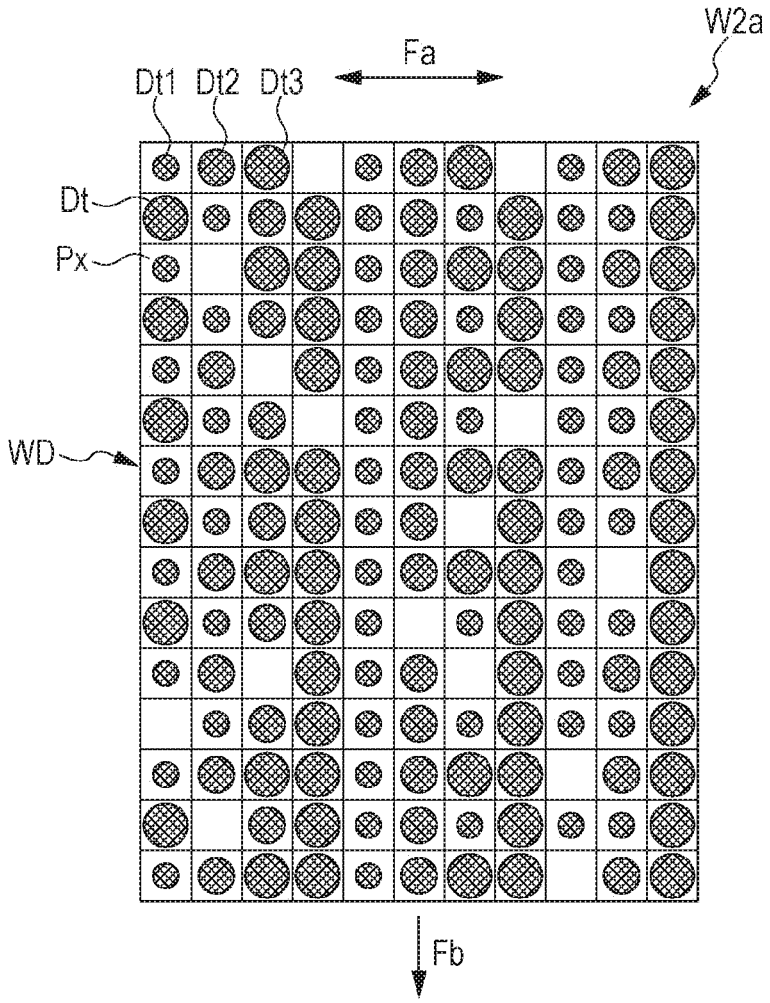
FIG. 4 is a schematic diagram describing the fibrous body manufacturing method according to the first embodiment.

FIG. 2 is a flow chart illustrating the fibrous body manufacturing method according to the present embodiment, and FIGS. 3 and 4 are schematic diagrams describing the fibrous body manufacturing method according to the present embodiment.

First, in step S11, a sheet-shaped second web W2 containing a plurality of fibers is accumulated. Specifically, the defibrated matter is disentangled by the accumulating section 60 and caused to descend while being dispersed in the air, and the second web W2 is accumulated on the second web forming section 70 with good uniformity.

Next, in step S12, the control section 300 segments the sheet-shaped second web W2 that is transported into a plurality of regions in which it is possible to discharge the liquid containing the binder. Specifically, as illustrated in FIG. 3, image data WD including a plurality of segments Px forming a dot matrix is set on virtual web data W2*a* corresponding to the second web W2. The image data WD is configured of a plurality of the segments Px along a transport direction Fb of the second web W2 and a main scanning direction Fa perpendicular to the transport direction of the second web W2 in the virtual web data W2*a*. The image data WD is recorded in, for example, a ROM or the like. Specifically, the image data WD is provided according to the size of the sheet S to be manufactured. The image data WD according to the size of the sheet S to be manufactured is set by the user inputting the size of the sheet S to be manufactured into an input device of the computer 1, for example, A3 size or A4 size. The resolution of the segment Px of the image data WD is set to a resolution within a range in which the discharge head 125 of the droplet discharging section 120 is capable of discharging onto the second web W2.

Next, in step S13, the control section 300 generates discharge data HD in which discharge information on the liquid is set for each of the plurality of segments Px. Specifically, as illustrated in FIG. 4, the discharge amount of the liquid is set as the discharge information for each of the segments Px. In FIG. 4, for ease of explanation, dots Dt simulating the discharge amount of the liquid are displayed in each of the segments Px. In the present embodiment, 2-bit dot data having four gradations is set for each of the segments Px. Specifically, there is no dot corresponding to the gradation value [00], discharging of a small dot Dt1 corresponding to the gradation value [01], discharging of a medium dot Dt2 corresponding to the gradation value [10], and discharging of a large dot Dt3 corresponding to the gradation value [11] are set. The medium dot Dt2 has a larger discharge amount than the small dot Dt1 and the large dot Dt3 has a larger discharge amount than the medium dot Dt2. The discharge data HD in which the dot data set for each of the segments Px is associated with each nozzle of the discharge head 125 is generated.

The discharge information for each of the segments Px is recorded in a ROM or the like, for example. Specifically, the discharge information for each of the segments Px may be set according to the characteristics of the sheet S manufactured by each manufacturing apparatus or the characteristics of the sheet S desired by the user. Since the tensile strength of the sheet S manufactured by each manufacturing apparatus may be different, the tensile strength may be used as the characteristic of the sheet to be manufactured by each manufacturing apparatus. In this case, it is necessary to apply more binder to locations within the sheet causing a reduction in strength. Therefore, the discharge information in which a larger discharge amount of the liquid is given to the segment Px corresponding to a location causing the decrease in strength is set. In other words, it is possible to appropriately modify the discharge amount for each of the segments Px according to the strength of the binding between the fibers, and it is possible to secure the stable strength of the entirety of the sheet S.

The discharge information may be the discharge amount of the liquid for each of the segments Px, the order in which droplets are discharged for each of the segments Px, or the like.

Since the user may wish to intentionally control the binding strength between the fibers in the sheet S, the strength or the like may be used as the characteristic of the sheet S desired by the user. In this case, in the sheet S, the discharge information that individually defines the discharge amount of the liquid is set in the segment Px corresponding to the location desired by the user. Accordingly, it is possible makes it possible to easily handle the characteristics of the sheet S desired by the user.

The user selects and inputs desired discharge information from the input device of the computer 1 to set the discharge information according to each characteristic and the discharge data HD is generated based on the discharge information.

Since steps S12 and S13 are processes performed by the control section 300, it is possible to carry out steps S12 and S13 before step S11.

Next, in step S14, the control section 300 causes the droplet discharging section 120 to discharge the liquid as droplets toward the second web W2 based on the discharge data HD and applies the liquid to the second web W2.

In the present embodiment, the droplets are discharged from the nozzles onto the second web W2 that is transported while causing the discharge head 125 of the droplet discharging section 120 to reciprocate in the main scanning direction Fa and the liquid containing the binder is applied to the second web W2.

In the present embodiment, a buffer mechanism for temporarily storing the second web W2 accumulated on the second web forming section 70 by the accumulating section 60 may be provided upstream of the droplet discharging section 120 in the transport direction, for example, between the transport section 79 and the pressurizing section 82 of the sheet forming section 80. With this configuration, it is possible to easily perform the transport control of the second web W2 relative to the droplet discharging section 120.

The second web W2 to which the liquid containing the binder is applied is heated by the heating section 84 in step S15 and subsequently cut by the cutting section 90 in step S16 to mold a single-cut sheet S of a predetermined size.

As described above, according to the present embodiment, it is possible to obtain the following effects.

By discharging droplets from the droplet discharging section 120 based on the discharge data HD in which the discharge information is set for each of the segments Px, it is possible to adhere different amounts of binder to each location in the surface of the second web W2. Accordingly, it is possible to set a larger amount of binder to be discharged on the segments Px corresponding to the regions in which the binding between the fibers is relatively weak. In addition, it is possible to control the binding strength between fibers at each location of the fibrous material. In other words, it becomes possible to appropriately set the application amount of the binder according to each location in the accumulated second web W2 and it is possible to secure stable strength of the entirety of the sheet S.

2. Second Embodiment

Figure 5:
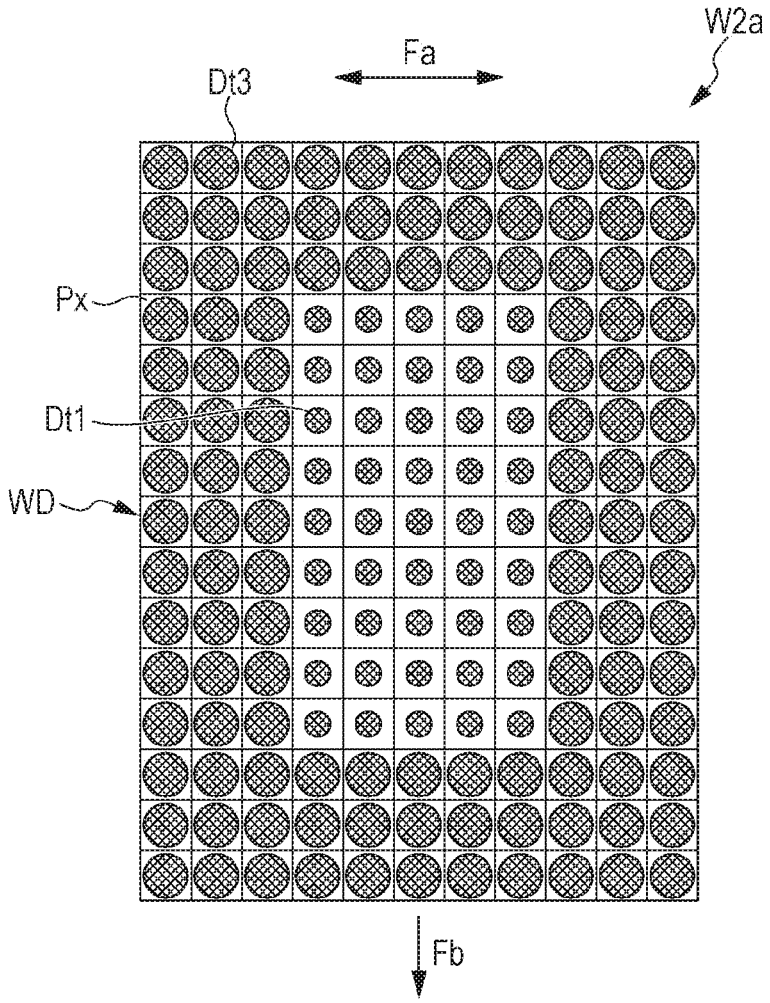
FIG. 5 is a schematic diagram describing a fibrous body manufacturing method according to a second embodiment.

Next, a second embodiment will be described. In the present embodiment, a configuration different from the first embodiment, that is, a control method of the control section 300 in the fibrous body manufacturing method will be described. FIG. 5 is a schematic diagram describing the fibrous body manufacturing method according to the present embodiment.

As illustrated in FIG. 5, the control section 300 generates the discharge data HD such that, among the plurality of segments Px, the discharge amount of the liquid in the segments Px on the outside is larger than the discharge amount of the liquid in the segments Px on the inside.

In the example of FIG. 5, the dot data for discharging the large dot Dt3 is set in the segments Px on the outside in the image data WD and the dot data for discharging the small dot Dt1 is set in the segments Px on the inside. In other words, the dot data is set such that the large dots Dt3 surround the periphery of the small dots Dt1 disposed in the center portion. The discharge data HD in which the dot data set for each of the segments Px is associated with each nozzle of the discharge head 125 is generated.

The control section 300 performs drive control of the droplet discharging section 120 based on the discharge data HD that is generated. Accordingly, the binding strength between the fibers on the outer peripheral side of the sheet S is further increased, and it is possible to increase the tensile strength of the sheet S.

Except for the control method of the control section 300, the configuration is the same as that of the first embodiment, and thus the description thereof is omitted.

3. Third Embodiment

Figure 6:
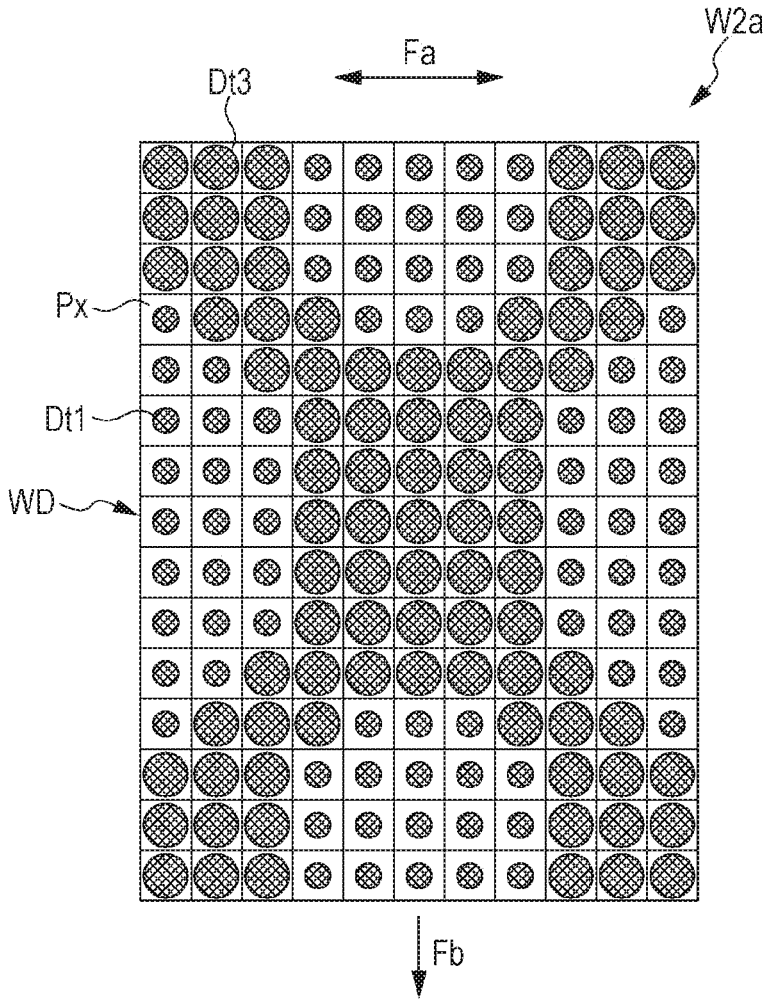
FIG. 6 is a schematic diagram describing a fibrous body manufacturing method according to a third embodiment.

Next, a third embodiment will be described. In the present embodiment, a configuration different from the first embodiment, that is, a control method of the control section 300 in the fibrous body manufacturing method will be described. FIG. 6 is a schematic diagram describing the fibrous body manufacturing method according to the present embodiment.

As illustrated in FIG. 6, the control section 300 generates the discharge data HD such that the discharge amount of the liquid in the segments Px corresponding to diagonal lines in the sheet-shaped second web W2 is larger than the discharge amount of the liquid in the segments Px other than the segments Px along the diagonal lines.

In the example of FIG. 6, of the image data WD, the dot data for discharging the large dot Dt3 is set in the segments Px disposed substantially on the diagonal lines and the discharge data for the small dot Dt1 is set in the other segments Px. In other words, the dot data is set such that the large dots Dt3 cross on the diagonal lines in the plurality of segments Px forming a dot matrix. The discharge data HD in which the dot data set for each of the segments Px is associated with each nozzle of the discharge head 125 is generated.

The control section 300 performs drive control of the droplet discharging section 120 based on the discharge data HD that is generated. Accordingly, the binding strength between the fibers in regions along the diagonal lines of the sheet S is further increased, and it is possible to increase the tensile strength of the sheet S.

4. Fourth Embodiment

Figure 7:
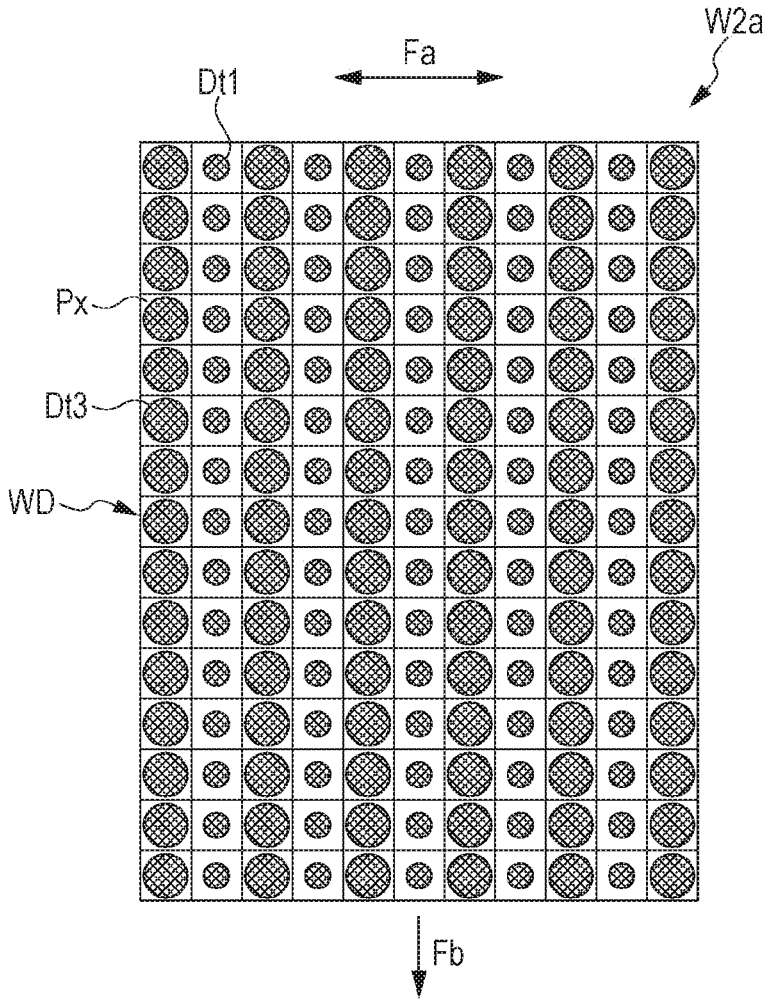
FIG. 7 is a schematic diagram describing a fibrous body manufacturing method according to a fourth embodiment.

Next, the fourth embodiment will be described. In the present embodiment, a configuration different from the first embodiment, that is, a control method of the control section 300 in the fibrous body manufacturing method will be described. FIG. 7 is a schematic diagram describing the fibrous body manufacturing method according to the present embodiment.

As illustrated in FIG. 7, the control section 300 generates the discharge data HD such that, among the plurality of segments Px, a region in which the discharge amount of the liquid is large and a region in which the discharge amount of the liquid is small are disposed along the transport direction Fb.

In the example of FIG. 7, in the image data WD, the dot data of the discharging of the large dot Dt3 is set in the segments Px corresponding to the regions in which the discharge amount of the liquid is large and the dot data of the discharging of the small dot Dt1 is set in the segments Px corresponding to the regions in which the discharge amount of the liquid is small. In other words, the control section 300 generates the discharge data HD in which rows of the large dots Dt3 disposed along the transport direction Fb and rows of the small dots Dt1 disposed along the transport direction Fb are disposed alternately along the main scanning direction Fa. In other words, the control section 300 generates the discharge data HD in which the rows in which the discharge amount of the liquid is large due to the large dots Dt3 and the rows in which the discharge amount of the liquid is relatively small due to the small dots Dt1 are alternately disposed along the main scanning direction Fa.

The control section 300 performs drive control of the droplet discharging section 120 based on the discharge data HD that is generated. Accordingly, since the regions of the sheet S in which the discharging is performed using the large dots Dt3 have a larger application amount of the binder as compared to the regions in which the discharging is performed using the small dots Dt1, the binding strength between the fibers is further enhanced. In the sheet S manufactured in this manner, when the sheet S is pulled in mutually different directions with respect to an axis along the transport direction Fb in a state in which the side portions on both ends of the sheet S intersecting the transport direction Fb are gripped, since the regions in which the discharging is performed using the large dots Dt3 and the regions in which the discharging is performed using the small dots Dt1 are formed along the stretching direction, the strength with respect to the pulling direction is strong. On the other hand, when the sheet S is pulled in mutually different directions with respect to an axis along the main scanning direction Fa in a state in which the side portions on both ends of the sheet S along the transport direction Fb are gripped, since the regions in which the discharging is performed using the small dots Dt1, that is, the regions in which the binding strength between the fibers is relatively weak are formed along the transport direction Fb, the sheet S breaks more easily along the regions in which the discharging is performed using the small dots Dt1. In other words, it is possible to manufacture the sheet S having a fiber grain (paper grain) along the transport direction Fb as the characteristic desired by the user.

5. Fifth Embodiment

Figure 8:
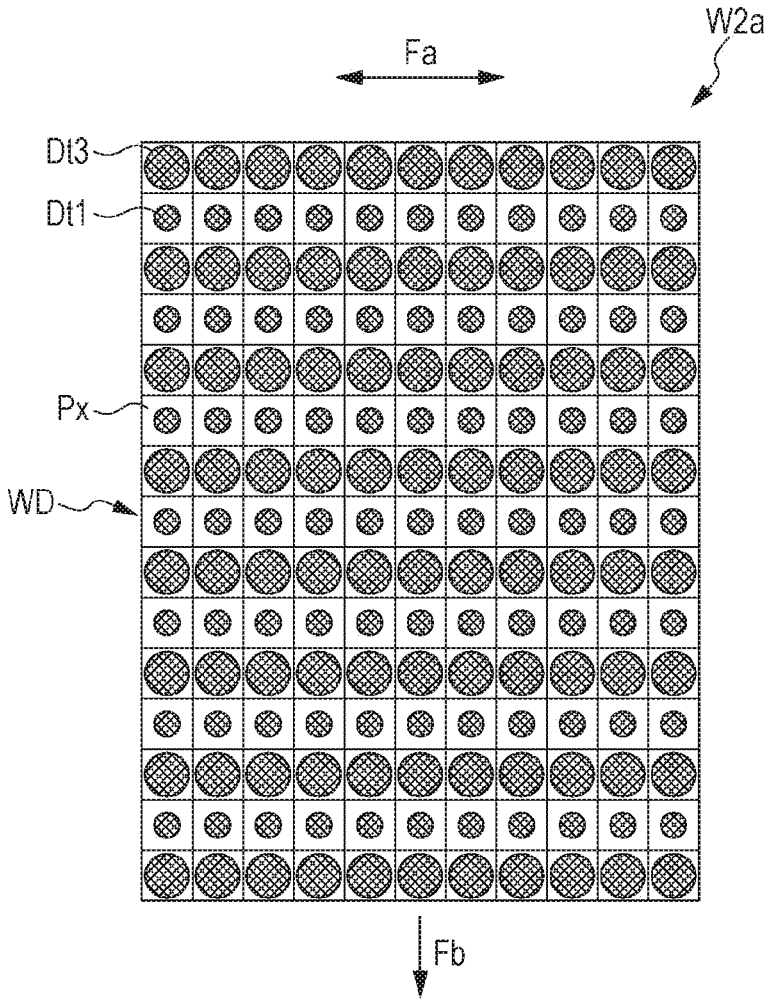
FIG. 8 is a schematic diagram describing a fibrous body manufacturing method according to a fifth embodiment.

Next, the fifth embodiment will be described. In the present embodiment, a configuration different from the first embodiment, that is, a control method of the control section 300 in the fibrous body manufacturing method will be described. FIG. 8 is a schematic diagram describing the fibrous body manufacturing method according to the present embodiment.

As illustrated in FIG. 8, the control section 300 generates the discharge data HD such that, among the plurality of segments Px, a region in which the discharge amount of the liquid is large and a region in which the discharge amount of the liquid is small are disposed along the main scanning direction Fa perpendicular to the transport direction Fb.

In the example of FIG. 8, in the image data WD, the dot data of the discharging of the large dot Dt3 is set in the segments Px corresponding to the regions in which the discharge amount of the liquid is large and the dot data of the discharging of the small dot Dt1 is set in the segments Px corresponding to the regions in which the discharge amount of the liquid is small. In other words, the control section 300 generates the discharge data HD in which columns of the large dots Dt3 disposed along the main scanning direction Fa and columns of the small dots Dt1 disposed along the main scanning direction Fa are disposed alternately along the transport direction Fb. In other words, the control section 300 generates the discharge data HD in which the columns in which the discharge amount of the liquid is large due to the large dots Dt3 and the columns in which the discharge amount of the liquid is relatively small due to the small dots Dt1 are alternately disposed along the transport direction Fb.

The control section 300 performs drive control of the droplet discharging section 120 based on the discharge data HD that is generated. Accordingly, since the regions of the sheet S in which the discharging is performed using the large dots Dt3 have a larger application amount of the binder as compared to the regions in which the discharging is performed using the small dots Dt1, the binding strength between the fibers is further enhanced. In the sheet S manufactured in this manner, when the sheet S is pulled in mutually different directions with respect to an axis along the main scanning direction Fa in a state in which the side portions on both ends of the sheet S along the transport direction Fb are gripped, since the regions in which the discharging is performed using the large dots Dt3 and the regions in which the discharging is performed using the small dots Dt1 are formed along the stretching direction, the strength with respect to the pulling direction is strong. On the other hand, when the sheet S is pulled in mutually different directions with respect to an axis along the transport direction Fb in a state in which the side portions on both ends of the sheet S intersecting the transport direction Fb are gripped, since the regions in which the discharging is performed using the small dots Dt1, that is, the regions in which the binding strength between the fibers is relatively weak are formed along the main scanning direction Fa, the sheet S breaks more easily along the regions in which the discharging is performed using the small dots Dt1. In other words, it is possible to manufacture the sheet S having the fiber grain (paper grain) along the main scanning direction Fa as the characteristic desired by the user.

6. Sixth Embodiment

Figure 9:
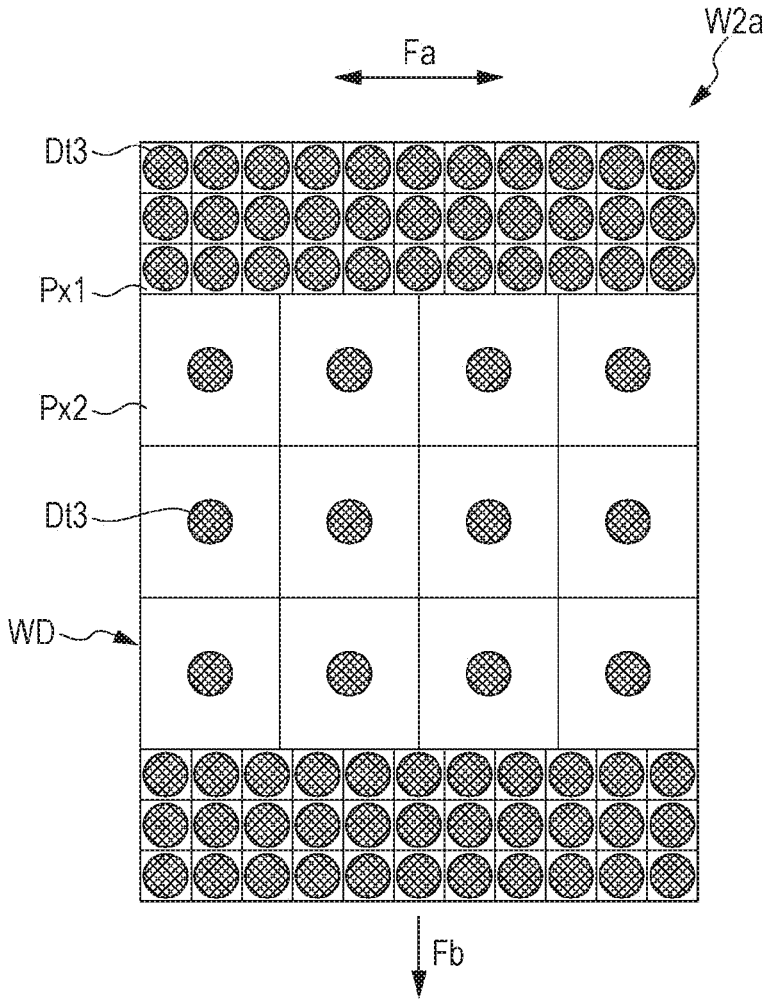
FIG. 9 is a schematic diagram describing a fibrous body manufacturing method according to a sixth embodiment.

Next, the sixth embodiment will be described. In the present embodiment, a configuration different from the first embodiment, that is, a control method of the control section 300 in the fibrous body manufacturing method will be described. FIG. 9 is a schematic diagram for explaining the fibrous body manufacturing method according to the present embodiment.

As illustrated in FIG. 9, the control section 300 renders the size of the segments Px different when segmenting into a plurality of sections. Specifically, the image data WD including a plurality of segments Px forming a dot matrix is set to the virtual web data W2*a* simulating the second web W2. The image data WD of the present embodiment is configured by first segments Px1 and second segments Px2 larger than the first segment Px1. In the example of FIG. 9, the first segments Px1 are disposed at the upstream end portion and the downstream end portion of the virtual web data W2*a* in the transport direction Fb and the second segments Px2 are disposed at the center portion of the virtual web data W2*a* in the transport direction Fb. In other words, the upstream end portion and the downstream end portion of the virtual web data W2*a* in the transport direction Fb have a higher matrix resolution than the center portion of the virtual web data W2*a* in the transport direction Fb. In this case, for example, the first segments Px1 are set to be dense in the region in which the binding strength between the fibers is relatively weak and the second segments Px2 are set to be coarse in the region in which the binding strength between the fibers is relatively strong.

In the example of FIG. 9, the dot data for the discharging of the large dot Dt3 is set in each of the first segments Px1 and the second segments Px2 in the image data WD. In other words, the dot data is set such that the discharge amount per unit is larger at the upstream end portion and the downstream end portion in the transport direction Fb with respect to the center portion. The discharge data HD in which the dot data set in each of the first segments Px1 and the second segments Px2 is associated with each of the nozzles of the discharge head 125 is generated.

The control section 300 performs drive control of the droplet discharging section 120 based on the discharge data HD that is generated. Accordingly, since the binder is densely applied to the regions in which the binding strength between the fibers is relatively weak, it is possible to increase the binding strength between the fibers. On the other hand, since the binder is applied in a rough state to the regions in which the binding strength between the fibers is relatively strong, it is possible to improve the discharge operation efficiency of the liquid containing the binder.

7. Seventh Embodiment

Figure 10A:
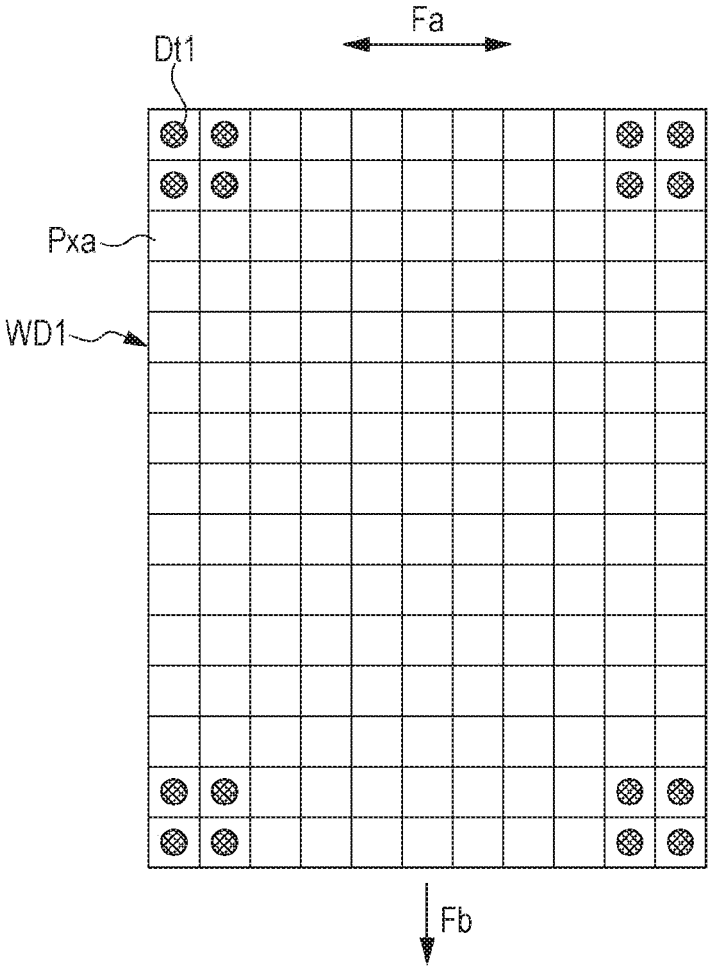
FIG. 10A is a schematic diagram describing a fibrous body manufacturing method according to a seventh embodiment.
Figure 10B:
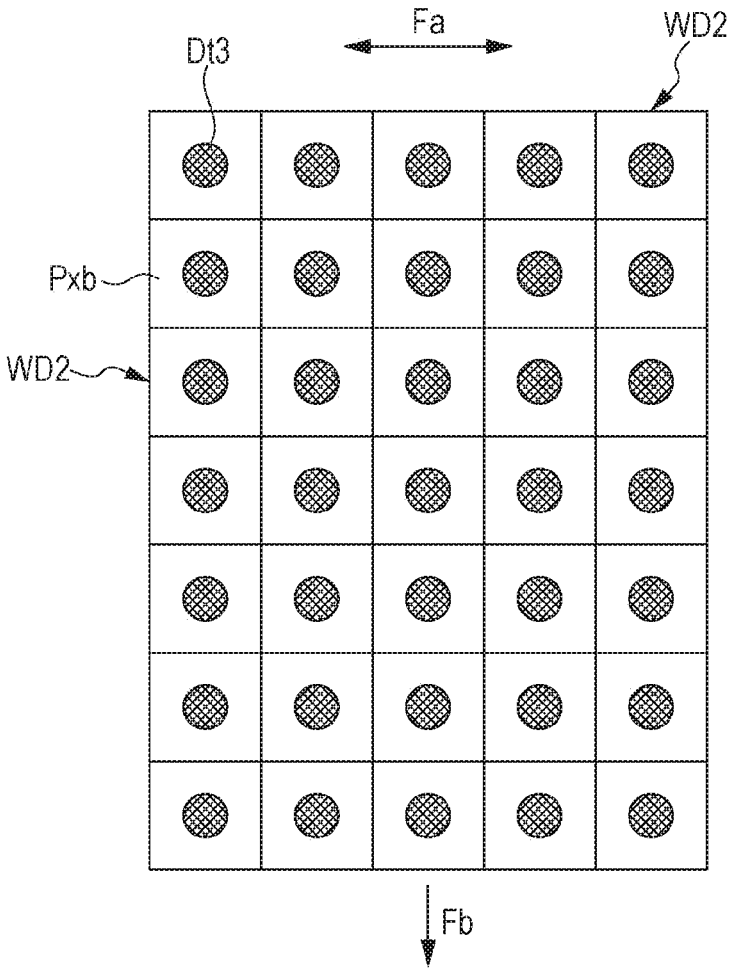
FIG. 10B is a schematic diagram describing the fibrous body manufacturing method according to the seventh embodiment.

Next, the seventh embodiment will be described. In the present embodiment, a configuration different from the first embodiment, that is, a control method of the control section 300 in the fibrous body manufacturing method will be described. FIGS. 10A and 10B are schematic diagrams describing the fibrous body manufacturing method according to the present embodiment.

The control section 300 sets first image data WD1 serving as first segmented region data configured of first segments Pxa and, separate from the first image data WD1, second image data WD2 serving as second segmented region data configured of second segments Pxb.

In the example of FIGS. 10A and 10B, the first segments Pxa of the first image data WD1 are smaller in size and denser, that is, the resolution is set to be higher than the second segments Pxb of the second image data WD2.

First discharge data HD1 in which the discharge information on the liquid is set for each of the first segments Pxa of the first image data WD1 is generated. In the example of FIG. 10A, the dot data for discharging the small dots Dt1 is set in the four first segments Pxa at each of the four corners of the first image data WD1, and the dot data without dots is set in the other first segments Pxa. The first discharge data HD1 in which the dot data set in the first segments Pxa is associated with each nozzle of the discharge head 125 is generated.

Second discharge data HD2 in which the discharge information on the liquid is set for each of the second segments Pxb of the second image data WD2 is generated. In the example of FIG. 10B, the dot data for discharging the large dot Dt3 is set in all of the second segments Pxb of the second image data WD2. The second discharge data HD2 in which the dot data set in the second segments Pxb is associated with each nozzle of the discharge head 125 is generated.

In the present embodiment, for example, a larger amount of the binder is applied to the segments of the second web W2 corresponding to the regions in which the binding between the fibers is relatively weak. Therefore, in the example of the present embodiment, the first discharge data HD1 for discharging more droplets to the four first segments Pxa at each of the four corners of the first image data WD1 is generated. The second discharge data HD2 is generated such that the droplets are uniformly discharged over the entirety of the second image data WD2.

The control section 300 performs drive control of the droplet discharging section 120 based on the first discharge data HD1 and the second discharge data HD2 that are generated. In the present embodiment, first, the liquid containing the binder is discharged based on the first discharge data HD1. In other words, first, the liquid containing the binder is discharged only on the first segments Pxa in which the binding between the fibers is relatively weak. Next, the liquid containing the binder is discharged based on the second discharge data HD2. In other words, the liquid is discharged onto the entire region of the second web W2.

After discharging the liquid containing the binder based on the first discharge data HD1, the second web W2 is back-fed to a predetermined position in the direction opposite to the transport direction Fb, and when the liquid containing the binder is discharged based on the second discharge data HD2, the second web W2 is moved in the transport direction Fb.

According to the present embodiment, it is possible to secure the strength of the sheet S by using the first discharge data HD1 and the second discharge data HD2 in combination. Accordingly, it is possible to secure the strength of the entirety of the sheet S.

8. Eighth Embodiment

Figure 11:
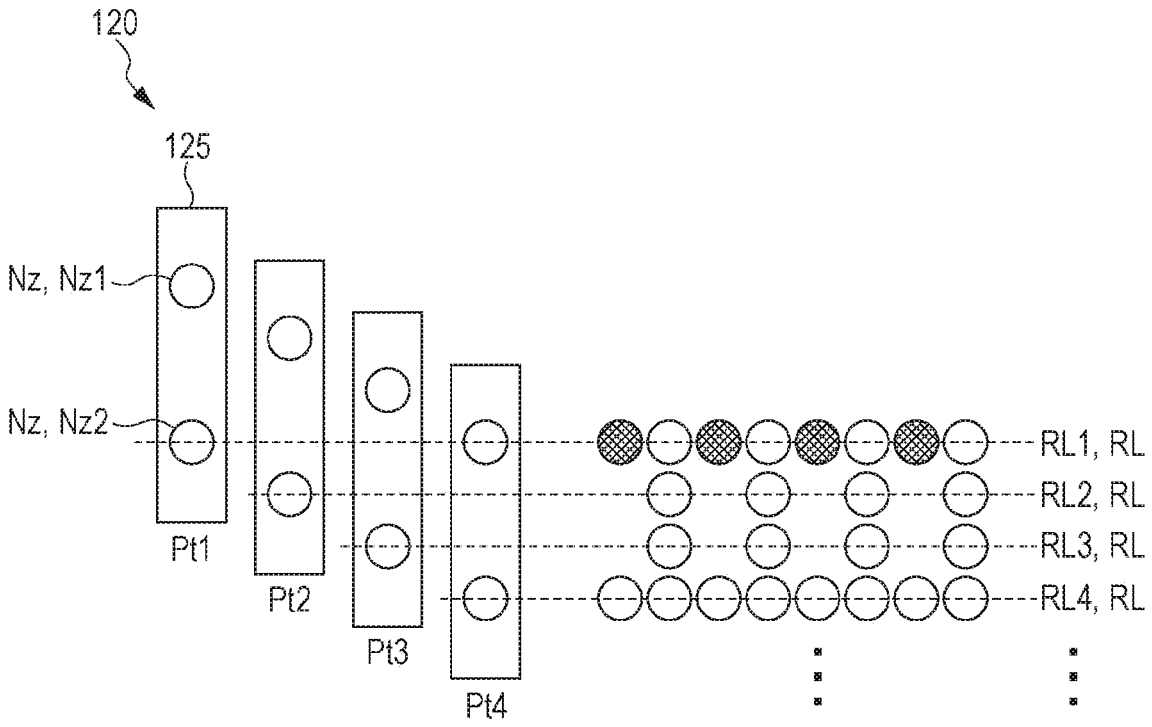
FIG. 11 is a schematic diagram describing a fibrous body manufacturing method according to an eighth embodiment.

Next, the eighth embodiment will be described. In the present embodiment, a configuration different from that of the first embodiment, that is, a discharging method of the droplet discharging section 120 will be described. FIG. 11 is a schematic diagram describing the fibrous body manufacturing method according to the present embodiment.

The droplet discharging section 120 alternately repeats a pass serving as a dot forming operation and a transport operation. In the dot forming operation, the droplet discharging section 120 causes the droplets to be discharged from each nozzle Nz while causing the discharge head 125 in which the plurality of nozzles Nz is provided to move reciprocally in the main scanning direction Fa with respect to the second web W2 to form a raster RL formed of a plurality of droplet dots arranged in the main scanning direction of the second web W2. In the transport operation, the second web W2 is transported in the transport direction Fb intersecting the main scanning direction Fa. Accordingly, the dots are arranged in the main scanning direction Fa and the transport direction Fb of the second web W2 and the liquid containing the binder is applied to the second web W2.

Incidentally, phenomena may arise relating to each of the nozzles Nz provided in the discharge head 125, for example, a nozzle omission in which a droplet is not discharged due to clogging or the like of the nozzle Nz, flight bending in which a droplet discharged from the nozzle Nz is discharged to a position deviating from a target position, and the droplet amount being larger or smaller than the other nozzles Nz. Here, when one raster RL is formed by one nozzle Nz, in a case in which the nozzle omission occurs, a raster RL in which no droplets are adhered occurs. When the flight bending occurs, the dots of adjacent rasters RL overlap each other and the application amount of the binder is unevenly applied as compared with the other portions. When the droplet amount is larger or smaller than that of the other nozzles Nz, the binder is unevenly applied on the surface of the second web W2.

Therefore, in the present embodiment, as illustrated in FIG. 11, the discharge data HD for discharging the liquid from the plurality of nozzles Nz is generated in the same raster RL, and the droplet discharging section 120 is driven using the discharge data. In FIG. 11, in order to facilitate the description, in the discharge head 125, two nozzles Nz of a first nozzle Nz1 and a second nozzle Nz2 are illustrated, the droplet dots formed by the first nozzle Nz1 are displayed hatched, and the droplet dots formed by the second nozzle Nz2 are displayed as white circles.

As illustrated in FIG. 11, in a first pass Pt1, droplets are discharged from the second nozzle Nz2 to form a portion of a first raster RL1. The expression "pass" in the present embodiment means that the discharge head 125 is operated once in one direction in the scanning direction.

Next, the discharge head 125 and the second web W2 are moved relative to each other by 1/3 of an inter-pitch dimension between the first nozzle Nz1 and the second nozzle Nz2, and a second pass Pt2 is performed. In the second pass Pt2, the droplets are discharged from the second nozzle Nz2 to form a portion of a second raster RL2.

Next, the discharge head 125 and the second web W2 are moved relative to each other by ⅓ of an inter-pitch dimension between the first nozzle Nz1 and the second nozzle Nz2, and a third pass Pt3 is performed. In the third pass Pt3, the droplets are discharged from the second nozzle Nz2 to form a portion of a third raster RL3.

Next, the discharge head 125 and the second web W2 are moved relative to each other by ⅓ of an inter-pitch dimension between the first nozzle Nz1 and the second nozzle Nz2, and a fourth pass Pt4 is performed. In the fourth pass Pt4, the droplets are discharged from the second nozzle Nz2 to form a portion of a fourth raster RL4. The droplets are discharged from the first nozzle Nz1. The droplets discharged from the first nozzle Nz1 are disposed between the droplet dots formed by the second nozzle Nz2. Accordingly, the first raster RL1 is completed. Subsequently, the above operations are repeated to form all of the rasters RL.

In the present embodiment, the same raster RL is formed by the droplet dots from the first nozzle Nz1 and the droplet dots from the second nozzle Nz2. Accordingly, it is possible to reduce the influence of the nozzles Nz due to nozzle omission, flight bending, and the like.

9. Ninth Embodiment

Figure 12:
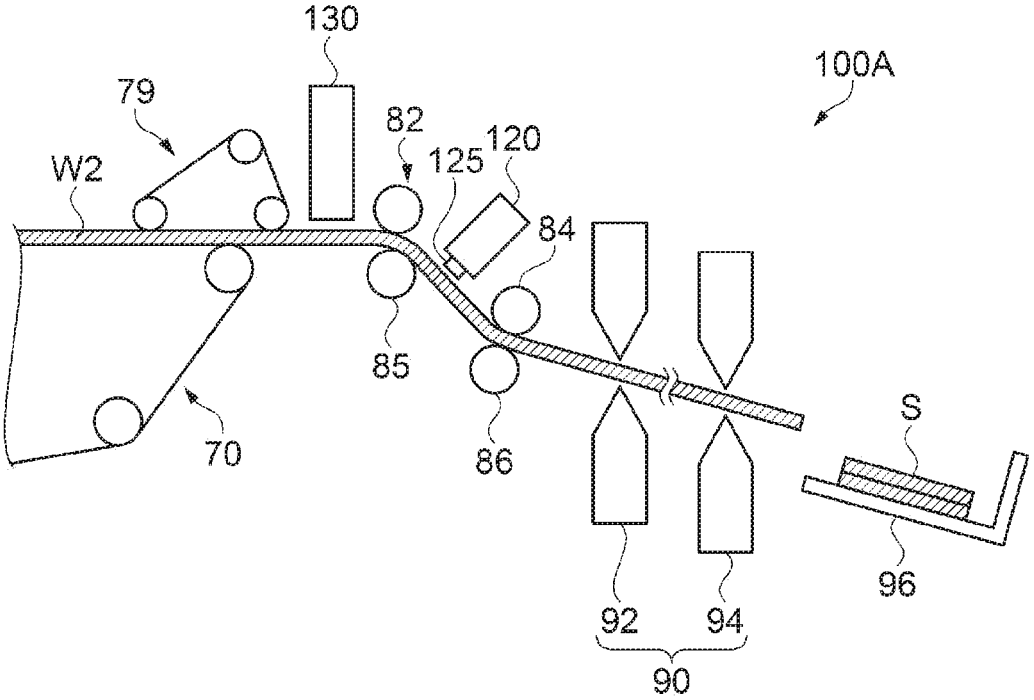
FIG. 12 is a schematic diagram illustrating a configuration of a fibrous body manufacturing apparatus according to a ninth embodiment.

Next, the ninth embodiment will be described. In the present embodiment, a configuration different from that of the first embodiment, that is, a configuration of a fibrous body manufacturing apparatus 100A to which a detection section 130 is added will be described. FIG. 12 is a schematic diagram illustrating the configuration of the fibrous body manufacturing apparatus according 100A to the present embodiment. FIG. 12 illustrates only the configuration of the peripheral portions of the detection section 130 and the droplet discharging section 120. The same numbers are used for the same components as those in the first embodiment and duplicate explanations will be omitted.

As illustrated in FIG. 12, the fibrous body manufacturing apparatus 100A is provided with the detection section 130 that acquires information on the second web W2 accumulated on the accumulating section 60. The detection section 130 is disposed between the transport section 79 and the pressurizing section 82 of the sheet forming section 80. The information on the second web W2 is, for example, thickness information, uneven shape information on the surface, fiber density information, and the like of the second web W2.

The detection section 130 is, for example, a line CCD sensor. The detection section 130 is coupled to the control section 300 and detection data acquired by the detection section 130 is transmitted to the control section 300. The control section 300 generates the image data WD, and further, the discharge data HD based on the transmitted detection data.

For example, when the detection section 130 acquires the uneven shape information on the surface of the second web W2, the control section 300 generates image data WD formed of the plurality of segments Px based on the acquired uneven shape information. For example, the control section 300 determines that the concave portions are thinner than the convex portions in the second web W2 based on the uneven shape information, and generates the image data WD such that the resolution of the segments Px corresponding to the concave portions is higher than the resolution of the segments Px corresponding to the convex portions. Next, the control section 300 generates the discharge data HD such that the discharge amount of the segments Px corresponding to the concave portions is larger than the discharge amount of the segments Px corresponding to the convex portions. The control section 300 subjects the droplet discharging section 120 to drive control based on the discharge data HD. Accordingly, it is possible to apply more binder to the concave portions of the second web W2, the binding strength between the fibers is increased, and it is possible to secure the strength of the entirety of the sheet S. Based on the detection data of the detection section 130, it is possible to quickly work together with the discharge control of the binder.

The detection section 130 is not limited to the line CCD sensor, and may be an optical camera, for example. The detection section 130 may be a transmissive sensor provided with a light emitting section and a light receiving section with the second web W2 pinched therebetween. The detection section 130 may also be an ultrasonic sensor.

The disposition position of the detection section 130 is not limited to being between the transport section 79 and the pressurizing section 82 of the sheet forming section 80. For example, the detection section 130 may be disposed downstream of the heating section 84 in the transport direction. Specifically, the detection section 130 may be disposed between the heating section 84 and the cutting section 90, or may be disposed between the cutting section 90 and the discharge section 96. Furthermore, the sheet S placed on the discharge section 96 may be disposed in a detectable manner. With this configuration, it is possible to control the discharge amount and the like based on the information on the formed sheet S.

10. Tenth Embodiment

Figure 13:
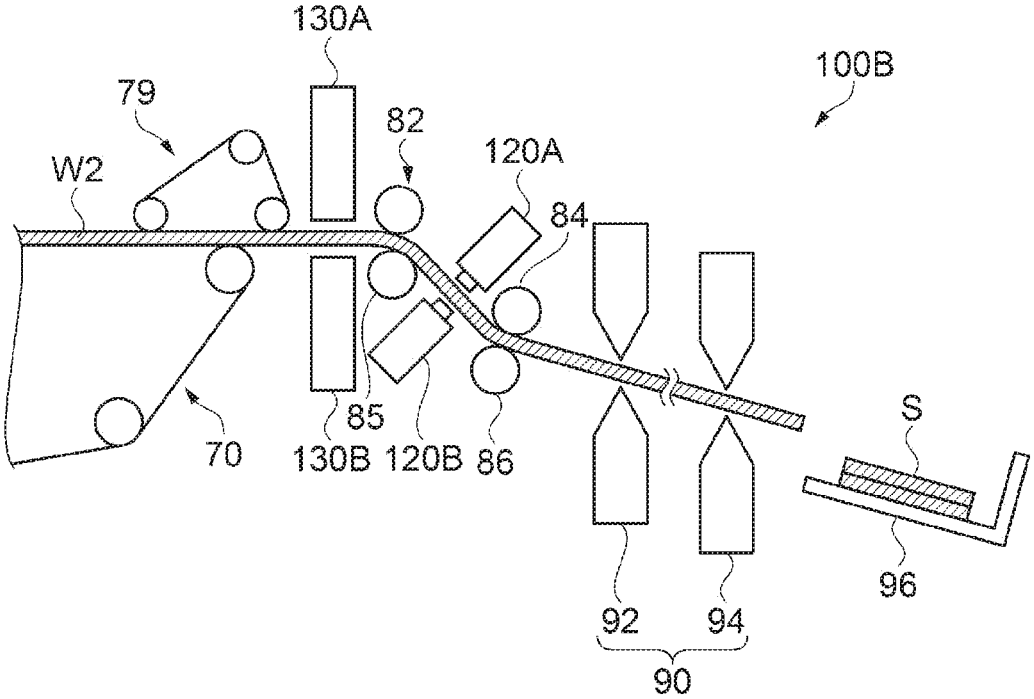
FIG. 13 is a schematic diagram illustrating a configuration of a fibrous body manufacturing apparatus according to a tenth embodiment.

Next, the tenth embodiment will be described. In addition, in the present embodiment, a configuration different from that of the ninth embodiment, that is, a configuration of a fibrous body manufacturing apparatus 100B provided with detection sections 130A and 130B and droplet discharging sections 120A and 120B will be described. FIG. 13 is a schematic diagram illustrating the configuration of the fibrous body manufacturing apparatus according 100B to the present embodiment. FIG. 13 illustrates only the configuration of the peripheral portions of the detection sections 130A and 130B and the droplet discharging sections 120A and 120B. The same numbers are used for the same components as those in the first embodiment and duplicate explanations will be omitted.

As illustrated in FIG. 13, the fibrous body manufacturing apparatus 100B is provided with the detection section 130A and the detection section 130B that acquire the information on the second web W2 accumulated on the accumulating section 60. The detection section 130A is disposed between the transport section 79 and the pressurizing section 82 of the sheet forming section 80. The detection section 130B is disposed to face the detection section 130A with the second web W2 pinched therebetween. Since the configurations of the detection sections 130A and 130B are the same as the configuration in the ninth embodiment, description thereof will be omitted.

The droplet discharging sections 120A and 120B are provided, and the droplet discharging section 120A is disposed between the pressurizing section 82 and the heating section 84. The droplet discharging section 120B is disposed to face the droplet discharging section 120A with the second web W2 pinched therebetween.

In other words, the fibrous body manufacturing apparatus 100B is configured to be capable of acquiring the information on both sides of the second web W2 and to be capable of discharging the liquid containing the binder as droplets onto both sides of the second web W2.

The detection sections 130A and 130B are coupled to the control section 300 and detection data acquired by the detection sections 130A and 130B is transmitted to the control section 300. The control section 300 generates the first image data WD1 and the first discharge data HD1 based on the detection data transmitted from the detection section 130A. The second image data WD2 is generated based on the detection data transmitted from the detection section 130B, and the second discharge data HD2 is generated.

The droplet discharging section 120A is driven based on the first discharge data HD1 and the droplet discharging section 120B is driven based on the second discharge data HD2.

The method of generating the first and second image data WD1 and WD2 and the method of generating the first and second discharge data HD1 and HD2 are the same as that of the ninth embodiment, and a description thereof will be omitted.

According to the present embodiment, since it is possible to apply the binder to both surfaces of the second web W2, it is possible to reliably secure the strength of the entirety of the sheet S.

11. Modification Example 1

In the above embodiments, configurations of the droplet discharging section 120 of a serial system are described as examples, but the configuration is not limited thereto. The droplet discharging section 120 may be of a line head system having a dimension greater than or equal to the width of the second web W2. A lateral system may be adopted in which the droplet discharging section 120 discharges droplets while causing the discharge head 125 to scan in the main scanning direction Fa and the transport direction Fb with respect to the second web W2 in which the transporting is stopped, and the second web W2 is intermittently transported in the transport direction Fb every time the liquid is applied to a region corresponding to one or a plurality of the sheets S in the second web W2.

12. Modification Example 2

In the eighth embodiment, although one raster RL is formed by using a plurality of the nozzles Nz, the present disclosure is not limited thereto, and for example, a microweave process in which adjacent rasters RL are formed by different nozzles Nz may be used. Even in this case, it is possible to reduce the influence of flight bending and the like.

The contents derived from the embodiment will be described below.

A fibrous body manufacturing apparatus for manufacturing a fibrous body includes an accumulating section that accumulates a sheet-shaped fibrous material containing a plurality of fibers, a droplet discharging section that discharges, as droplets, a liquid containing a binding material that binds the fibers of the accumulated fibrous material to each other, and a control section which segments a region in which the liquid is dischargeable onto the fibrous material into a plurality of segments, generates discharge data in which discharge information on the liquid is set for every one of the plurality of segments, and causes the liquid to be discharged from the droplet discharging section toward the fibrous material based on the discharge data.

According to this configuration, by discharging the droplets from the droplet discharging section based on the discharge data set for every one segment, for example, it is possible to adhere different amounts of the binding material to each location of the fibrous material. Accordingly, it is possible to discharge a larger amount of the binding material to the segments corresponding to regions in which the binding between the fibers is relatively weak and to control the binding strength between the fibers at various locations of the fibrous material. In other words, it becomes possible to appropriately set the application amount of the binding material according to each location in the accumulated fibrous material and it is possible to secure stable strength of the entirety of the fibrous body.

In the fibrous body manufacturing apparatus, it is preferable that the control section set the discharge amount of the liquid for every one of the segments as the discharge information.

According to this configuration, it is possible to appropriately modify the application amount for every one of the segments according to the strength of the binding between the fibers, and it is possible to perform efficient discharge control of the binding material. It is possible makes it possible to easily handle the characteristics of the fibrous body desired by the user. For example, it is possible to easily form the characteristics of the fiber grain such as a longitudinal grain or a lateral grain in the fibrous body, for example, a direction in which the paper is easily torn, a direction in which the paper is easily folded, and a direction in which the paper is easily curled.

In the fibrous body manufacturing apparatus, the control section may generate the discharge data such that, of the plurality of segments, the discharge amount of the liquid in the segments on an outside is larger than the discharge amount of the liquid in the segments on an inside.

According to this configuration, the binding strength between the fibers on the outer peripheral end side of the fibrous body is increased, and it is possible to increase the tensile strength of the fibrous body.

In the fibrous body manufacturing apparatus, it is preferable that the control section generate the discharge data such that the discharge amount of the liquid in the segments corresponding to diagonal lines on the sheet-shaped fibrous material is larger than the discharge amount of the liquid in the segments other than the segments along the diagonal lines.

According to this configuration, the binding strength between the fibers in the region along the diagonal lines of the fibrous body is increased, and it is possible to increase the tensile strength of the fibrous body.

In the fibrous body manufacturing apparatus, it is preferable that when the control section segments the region into the plurality of segments, sizes of the segments be made different.

According to this configuration, for example, the size of the segments corresponding to the regions in which the binding between the fibers is relatively weak is rendered smaller than the size of the segments corresponding to the regions in which the binding between the fibers is relatively strong. Accordingly, since the liquid containing the binding material is densely applied to the regions in which the binding between the fibers is relatively weak, it is possible to increase the binding strength between the fibers. On the other hand, since the liquid containing the binding material is applied in a rough state to the regions in which the binding strength between the fibers is relatively strong, it is possible to improve the discharge operation efficiency of the binding material.

In the fibrous body manufacturing apparatus, it is preferable that the control section set first segmented region data configured from first segments in which a region in which the liquid is dischargeable onto the fibrous material is treated as a plurality of segments, and, separately from the first segmented region data, set second segmented region data configured from second segments in which a region in which the liquid is dischargeable onto the fibrous material is treated as a plurality of segments, generate first discharge data in which the discharge information is set for every one of the first segments of the first segmented region data and causes the liquid to be discharged from the droplet discharging section toward the fibrous material based on the first discharge data, and generate second discharge data in which the discharge information is set for every one of the second segments of the second segmented region data and causes the liquid to be discharged from the droplet discharging section toward the fibrous material based on the second discharge data.

According to this configuration, it is possible to secure the strength of the fibrous body by using the first discharge data and the second discharge data in combination. For example, by using the first discharge data, the binding material is discharged onto, of the fibrous material, only the segments in which the binding between the fibers is relatively weak, and next the second discharge data is used to discharge the binding material onto all of the regions of the fibrous material. Accordingly, it is possible to secure the strength of the entirety of the fibrous body.

In the fibrous body manufacturing apparatus, it is preferable that the droplet discharging section be provided with a first nozzle and a second nozzle for discharging the liquid as droplets, and the control section generate the discharge data for discharging the liquid from the first nozzles and the second nozzles in the same raster in the plurality of segments.

According to this configuration, when the binding material is discharged from each of the nozzles, it is possible to reduce the influence on the nozzles caused by flight bending or the like.

It is preferable that the fibrous body manufacturing apparatus further include a detection section for acquiring information on the fibrous material accumulated on the accumulating section, and that the control section generate the discharge data based on detection data acquired by the detection section.

According to this configuration, based on the detection data of the detection section, it is possible to quickly work together with the discharge control of the binding material.

A fibrous body manufacturing method for manufacturing a fibrous body, the method including accumulating a sheet-shaped fibrous material containing a plurality of fibers, and segmenting a region in which a liquid containing a binding material that binds the fibers to each other is dischargeable onto the fibrous material into a plurality of segments, generating discharge data in which discharge information on the liquid is set for every one of the plurality of segments, and causing the liquid to be discharged toward the fibrous material based on the discharge data.

According to this configuration, by discharging the droplets based on the discharge data set for every one segment, for example, it is possible to adhere different amounts of the binding material to each location of the fibrous material. Accordingly, it is possible to discharge a larger amount of the binding material to the segments corresponding to regions in which the binding between the fibers is relatively weak and to control the binding strength between the fibers at various locations of the fibrous material. In other words, it becomes possible to appropriately set the application amount of the binding material according to each location in the accumulated fibrous material and it is possible to secure stable strength of the entirety of the fibrous body.

What is claimed is:

1. A fibrous body manufacturing apparatus for manufacturing a fibrous body, the apparatus comprising:

an accumulating section that accumulates a sheet-shaped fibrous material containing a plurality of fibers;

a droplet discharging section that discharges, as droplets, a liquid containing a binding material that binds the fibers of the accumulated fibrous material to each other; and a control section which segments a region in which the liquid is dischargeable onto the fibrous material into a plurality of segments, generates discharge data in which discharge information on the liquid is set for every one of the plurality of segments, and causes the liquid to be discharged from the droplet discharging section toward the fibrous material based on the discharge data.

2. The fibrous body manufacturing apparatus according to claim 1, wherein the control section sets a discharge amount of the liquid for every one of the segments as the discharge information.

3. The fibrous body manufacturing apparatus according to claim 2, wherein the control section generates the discharge data such that, of the plurality of segments, the discharge amount of the liquid in the segments on an outside is larger than the discharge amount of the liquid in the segments on an inside.

4. The fibrous body manufacturing apparatus according to claim 2, wherein the control section generates the discharge data such that the discharge amount of the liquid in the segments corresponding to diagonal lines on the sheet-shaped fibrous material is larger than the discharge amount of the liquid in the segments other than the segments along the diagonal lines.

5. The fibrous body manufacturing apparatus according to claim 1, wherein when the control section segments the region into the plurality of segments, sizes of the segments are made different.

6. The fibrous body manufacturing apparatus according to claim 1, wherein the control section sets first segmented region data configured from first segments formed by segmenting a region in which the liquid is dischargeable onto the fibrous material into a plurality of segments, and, separately from the first segmented region data, sets second segmented region data configured from second segments formed by segmenting a region in which the liquid is dischargeable onto the fibrous material into a plurality of segments, generates first discharge data in which the discharge information is set for every one of the first segments of the first segmented region data and causes the liquid to be discharged from the droplet discharging section toward the fibrous material based on the first discharge data, and generates second discharge data in which the discharge information is set for every one of the second segments of the second segmented region data and causes the liquid to be discharged from the droplet discharging section toward the fibrous material based on the second discharge data.

7. The fibrous body manufacturing apparatus according to claim 1, wherein the droplet discharging section is provided with a first nozzle and a second nozzle for discharging the liquid as droplets, and the control section generates the discharge data for discharging the liquid from the first nozzles and the second nozzles in the same raster in the plurality of segments.

8. The fibrous body manufacturing apparatus according to claim 1, further comprising:

a detection section for acquiring information on the fibrous material accumulated on the accumulating section, wherein the control section generates the discharge data based on detection data acquired by the detection section.

* * * * *